US011805893B2

(12) United States Patent
Reddig et al.

(10) Patent No.: US 11,805,893 B2
(45) **Date of Patent: *Nov. 7, 2023**

(54) RECONFIGURABLE WORK STATION, WORK SPACE, AND WORK SPACE SYSTEM

(71) Applicant: Haworth, Inc., Holland, MI (US)

(72) Inventors: Ralph E. Reddig, Holland, MI (US); Jeffrey J. Reuschel, Hamilton, MI (US); Ross S. Johnson, Jenison, MI (US); Shawn Yu, Hudsonville, MI (US); Bryan Gingrich, Holland, MI (US)

(73) Assignee: Haworth, Inc., Holland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/846,332

(22) Filed: Jun. 22, 2022

(65) Prior Publication Data

US 2022/0312956 A1 Oct. 6, 2022

Related U.S. Application Data

(63) Continuation of application No. 17/114,953, filed on Dec. 8, 2020, now Pat. No. 11,395,543.

(51) Int. Cl.
*A47B 11/00* (2006.01)
*A47B 9/20* (2006.01)
(Continued)

(52) U.S. Cl.
CPC ..... *A47B 11/00* (2013.01); *A47B 9/20* (2013.01); *A47B 13/081* (2013.01); *A47B 21/06* (2013.01); *A47B 2200/0052* (2013.01)

(58) Field of Classification Search
CPC ..... A47B 21/00; A47B 21/02; A47B 21/03; A47B 2200/0066; A47B 2200/008; A47B 11/00
(Continued)

(56) References Cited

U.S. PATENT DOCUMENTS 3,817,191 A 6/1974 Hansen et al.
3,963,288 A 6/1976 Burnett
(Continued)

FOREIGN PATENT DOCUMENTS

CN 208821858 5/2019
JP 08019438 1/1996

*Primary Examiner* — Jose V Chen
(74) *Attorney, Agent, or Firm* — Warner Norcross + Judd LLP

(57) ABSTRACT

A reconfigurable work station includes a work surface supported atop a pedestal and base. A linkage arm is affixed to the base or pedestal at a first end and pivotally connected to a fixed member at a second end. The work station can pivot, with the linkage arm, about the fixed member to be selectively positioned in multiple positions. The pedestal may be height adjustable and the work surface may be rotatable atop the pedestal. Alternatively, the work station can include two pedestals and the linkage arm can be rotatably connected to one of the pedestals to rotate the work station, as well as to pivot the work station about the fixed member. A work space includes the work station and at least one wall panel, and a work space system includes multiple work spaces. Work stations within respective work spaces can be selectively positioned in focused or collaborative configurations.

31 Claims, 32 Drawing Sheets

(51) Int. Cl.
*A47B 13/08* (2006.01)
*A47B 21/06* (2006.01)

(58) Field of Classification Search
USPC ..... 108/50.01, 50.02, 103, 139
See application file for complete search history.

(56) References Cited

U.S. PATENT DOCUMENTS

| | | | | |
|---|---|---|---|---|
| 4,852,500 | A | 8/1989 | Ryburg et al. | |
| 4,870,908 | A | 10/1989 | Wolters et al. | |
| 5,899,148 | A | 5/1999 | Buono | |
| 5,967,058 | A | 10/1999 | Ambrose et al. | |
| 6,158,831 | A | 12/2000 | Brown et al. | |
| 6,161,487 | A | 12/2000 | Chang | |
| 6,220,186 | B1 | 4/2001 | Scharer et al. | |
| 6,298,794 | B1 | 10/2001 | Brown et al. | |
| 6,543,369 | B1 | 4/2003 | Swensson et al. | |
| 6,588,346 | B1 | 7/2003 | Bockheim et al. | |
| 6,931,795 | B1 | 8/2005 | Baloga et al. | |
| 6,997,114 | B2 | 2/2006 | Chang | |
| 7,806,376 | B2 | 10/2010 | Song et al. | |
| 7,823,973 | B2 | 11/2010 | Dragusin | |
| 8,171,862 | B2 | 5/2012 | Muirhead | |
| 8,191,487 | B2 | 6/2012 | Theesfeld et al. | |
| 8,485,111 | B2 | 7/2013 | Chinuki et al. | |
| 8,935,985 | B2 | 1/2015 | Hjelm | |
| D778,652 | S | 2/2017 | Siebert et al. | |
| 9,622,570 | B1 | 4/2017 | Holdredge et al. | |
| 9,980,561 | B1 | 5/2018 | Constantino et al. | |
| D840,177 | S | 2/2019 | Hecht et al. | |
| 11,395,543 | B2 * | 7/2022 | Reddig ..... | A47B 83/04 |
| 2002/0011193 | A1 | 1/2002 | Beck et al. | |
| 2004/0082334 | A1 | 4/2004 | Petrick et al. | |
| 2005/0022699 | A1 | 2/2005 | Goza | |
| 2006/0005748 | A1 | 1/2006 | Christians | |
| 2006/0156963 | A1 | 7/2006 | Fischer | |
| 2006/0284529 | A1 | 12/2006 | Milutinovics et al. | |
| 2008/0040982 | A1 | 2/2008 | Durand et al. | |
| 2010/0101461 | A1 | 4/2010 | Brault et al. | |
| 2010/0126394 | A1 | 5/2010 | Burak et al. | |
| 2010/0148647 | A1 | 6/2010 | Burgess et al. | |
| 2011/0017688 | A1 | 1/2011 | Jines et al. | |
| 2011/0239908 | A1 | 10/2011 | Nakamura et al. | |
| 2012/0031310 | A1 | 2/2012 | Jedrysik et al. | |
| 2012/0085270 | A1 | 4/2012 | Schroer et al. | |
| 2012/0119040 | A1 | 5/2012 | Ergun et al. | |
| 2012/0199051 | A1 | 8/2012 | Edinger et al. | |
| 2013/0061783 | A1 | 3/2013 | Bennie et al. | |
| 2013/0200660 | A1 | 8/2013 | Bahnof | |
| 2013/0284075 | A1 | 10/2013 | Reithler | |
| 2014/0020606 | A1 | 1/2014 | Benden | |
| 2014/0096706 | A1 | 4/2014 | Labrosse et al. | |
| 2014/0208985 | A1 | 7/2014 | DesRoches et al. | |
| 2014/0312754 | A1 | 10/2014 | Hecht et al. | |
| 2014/0360412 | A1 | 12/2014 | Zaccai et al. | |
| 2015/0047538 | A1 | 2/2015 | Ergun et al. | |
| 2015/0320203 | A1 | 11/2015 | Mandon et al. | |
| 2016/0235193 | A1 | 8/2016 | Reddig | |
| 2017/0000255 | A1 | 1/2017 | Herring et al. | |
| 2017/0071332 | A1 | 3/2017 | Herring et al. | |
| 2017/0099943 | A1 | 4/2017 | Joshi et al. | |
| 2020/0154881 | A1 | 5/2020 | Applegate et al. | |
| 2020/0260862 | A1 | 8/2020 | Knapp et al. | |
| 2020/0261294 | A1 | 8/2020 | Lao | |

* cited by examiner

RECONFIGURABLE WORK STATION, WORK SPACE, AND WORK SPACE SYSTEM

The present invention relates to work stations, work spaces, and work space systems, and more particularly to a reconfigurable work station where the work surface can be moved to multiple positions such that the work station and work space can be utilized for collaborative or focused work.

Wall panel systems have long been used for dividing large, open floor spaces into smaller work spaces. The wall panels, also known as partition panels, are arranged in desired geometrical configurations to define individual work stations and/or offices. A typical work station includes a rigid work surface capable of supporting various devices, such as computers, monitors, keyboards, and telephones. Work stations may provide a suitable space for an individual to work; however, work stations are generally not conducive to co-workers working interactively or collaboratively. Typically, if co-workers wish to work collaboratively, they choose to leave their work stations in favor of another space, perhaps a conference room or a meeting table.

SUMMARY

A reconfigurable work station includes a work surface supported atop a pedestal and a base. A linkage arm extends between the pedestal and a fixed member, a floor surface, or wall panel, for example, to connect the pedestal and the fixed member. The connection between the linkage arm and the fixed member is a pivotal connection. Thus, the work station can be pivoted, with the linkage arm, to selectively move the work station to multiple different positions.

In another embodiment, a reconfigurable work space includes one or more wall panels and a work station. The work station includes a work surface supported atop a pedestal and base, and a linkage arm connecting the pedestal and the wall panel. The linkage arm is connected to the base or pedestal at one end and pivotally connected to the wall panel at the other end. Accordingly, the work station can pivot with the linkage arm such that the work station is movable to a plurality of positions relative to the work space.

In yet another embodiment, a reconfigurable work space system includes at least first and second work spaces. The first and second work spaces are arranged to be open toward one another and to have collinear but spaced first wall panels. Further, the work spaces define a walkway therebetween. The work space system includes first and second work stations, and each work station includes a work surface supported atop a pedestal and base. Each of the work stations includes a linkage arm that pivotally connects the pedestal and the respective first wall panel. The first and second work stations are configured to pivot with their respective linkage arms relative to respective wall panels. Accordingly, the first and second work stations are movable to a plurality of positions relative to the work space.

In any of the embodiments herein, the pedestal may be height adjustable such that the work surface is configured to raise and lower.

In some embodiments, the work surface may be rotatably mounted atop the pedestal.

In some embodiments, the work station may include two spaced pedestals. An elongated base can extend between the two pedestals, coupling them together, and may include at least two support legs which extend horizontally from the base. The linkage arm can be pivotally connected to the base at its first end, and the linkage arm, base, pedestals, and work surface can pivot about the fixed member or wall panel to change the position of the work station. Further, the base, pedestals, and work surface can rotate about the second end of the linkage arm to change the orientation of the work surface.

In some embodiments, the linkage arm is a two piece linkage arm that includes two segments pivotally joined together.

In another embodiment, a movable work station includes a work surface, two spaced pedestals supporting the work surface, and a base with the pedestals extending up therefrom. The work station also includes a sliding linkage mechanism mounted to the base. The sliding linkage mechanism is pivotally attached to a fixed member at one end and both rotatably and slidably affixed to the base at the other end. The work station can be pivoted with the sliding linkage mechanism about the fixed member to change the pivotal position of the work station. The work station can be rotated about the sliding linkage mechanism to change the rotational orientation of the work station, and can also be slid a distance along the sliding linkage mechanism to linearly change the position of the work station.

In yet another embodiment, a reconfigurable work space includes at least one wall panel and a work station. The work station includes a work surface and two spaced pedestals, a base, and a tether mechanism. The tether mechanism is affixed to one of the pedestals and to one of the wall panels. The work station can be pivoted with the tether mechanism about a wall panel attachment point to change the pivotal position of the work station. Further, the work station can be rotated about a pedestal attachment point to change the rotational orientation of the work station. Accordingly, the work station can be moved to a variety of positions relative to the work space, while the tether mechanism limits the movement of the work station within the work space.

These and other objects, advantages, and features of the disclosure will be more fully understood and appreciated by reference to the description of the current embodiment and the drawings.

Before the embodiments of the disclosure are explained in detail, it is to be understood that the disclosure is not limited to the details of operation or to the details of construction and the arrangement of the components set forth in the following description or illustrated in the drawings. The disclosure may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the disclosure any additional steps or components that might be combined with or into the enumerated steps or components.

DESCRIPTION OF THE EMBODIMENT

A reconfigurable work station 10 that can be selectively disposed in multiple use configurations is shown in accordance with one embodiment as disclosed herein. The work station can be provided within an individual work space and may be easily positioned and repositioned within the work space as desired. Additionally, multiple work spaces can be arranged together to create a work space system that can be customized to meet the needs of a particular floor plan, office layout, or other space. The work space system can provide independent, personal work spaces with all the user control, accessibility, and functionality that workers might need for individual work, while offering group collaboration and communication that is sometimes desired in an office environment.

Referring to FIGS. 1-4, the work station 10 includes a work surface 14 mounted atop a height adjustable pedestal 12, enabling a user to raise and lower the work surface 14 as desired. The work surface 14 can be rotated, in a substantially horizontal plane, relative to the pedestal 12, and can be rotated at least 90° and may rotate 180° or more. The work station 10 also includes a linkage arm 16 connecting the pedestal 12 to a fixed point or member, such as a floor surface, a portion of a wall panel system, a wall, or other suitable structure. The ability to change the rotational orientation of the work surface 14, the ability to raise and lower the work surface 14, and the ability to pivot the work station 10 together provide a number of different positions, orientations, heights, and/or overall configurations in which the work station 10 may be arranged.

Throughout this description, directional terms, such as "vertical," "horizontal," "top," "bottom," "upper," "lower," "inner," "inwardly," "outer" and "outwardly," may be used to assist in describing the structure based on the orientation of the embodiments shown in the illustrations. The use of directional terms should not be interpreted to limit the structure to any specific orientation(s). Further, as used herein, the term "pivot" is used primarily to describe movement of the work station along an arc or path on the floor; as described in detail below, this generally refers to the pivotal position in which the work station is disposed. The term "rotate" is used herein primarily to describe the turning of the work surface in a substantially horizontal plane; the term "orientation" is used herein primarily to describe the alignment of the work surface when rotated. Lastly, the term "configuration" is used herein to generally describe the arrangement of components relative to one another, including the state of the work station when disposed in a combination of pivotal position, rotational orientation, and/or work surface height.

Figure 19:
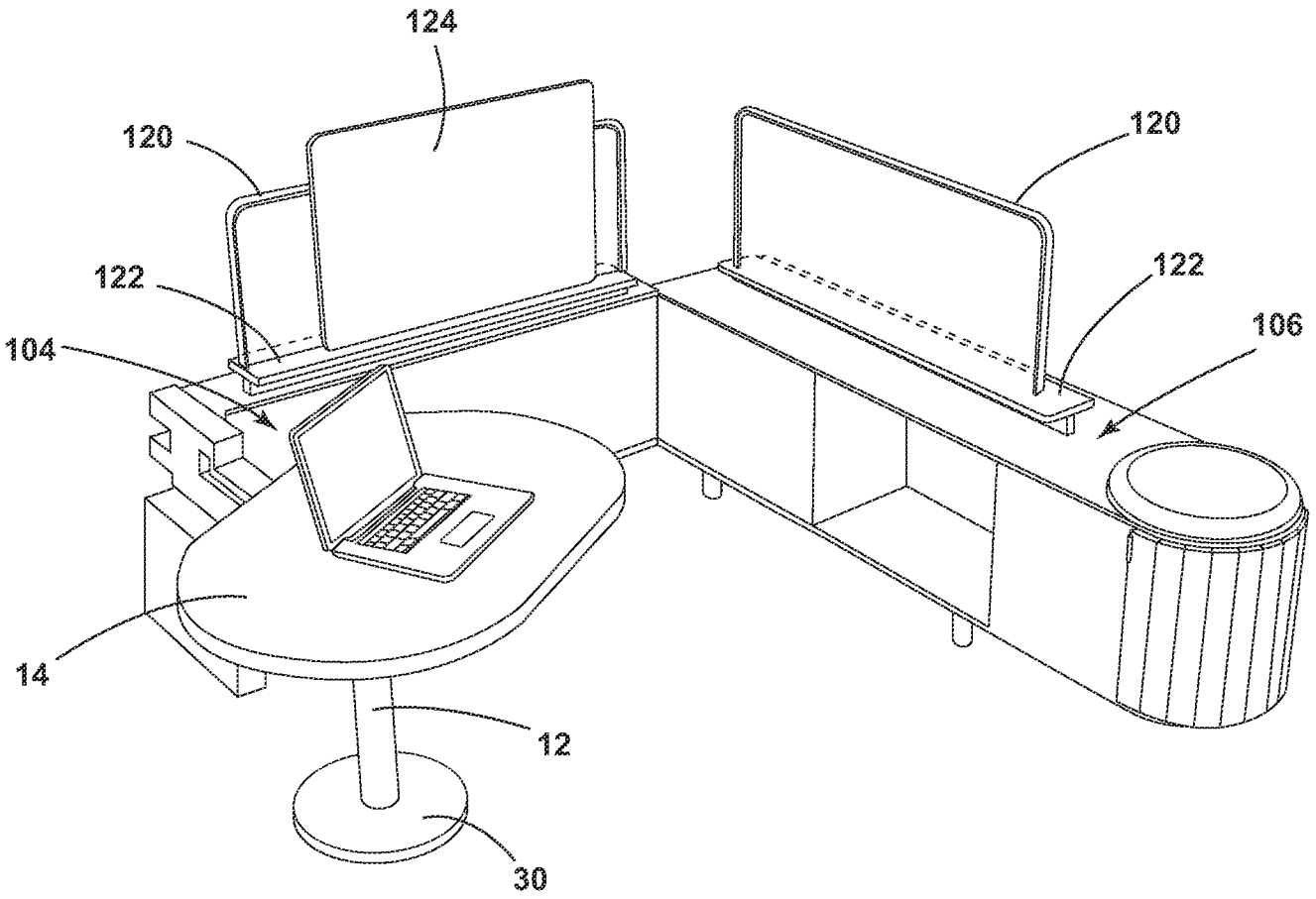
FIG. 19 is a perspective view of a work space including an exemplary alternate shaped work surface.

Referring to the illustrated embodiment shown in FIGS. 1-4, the reconfigurable work station 10 generally includes a pedestal 12, a work surface 14, and linkage arm 16. The work surface 14 defines an upper surface 20, a lower surface 22, a first perimeter side 24, and a second perimeter side 26. The work surface 14 is generally rectangular; the first perimeter side 24 is longer than the second perimeter side 26. In the exemplary embodiment, a rectangular work surface 14 is illustrated; however, other suitable work surface shapes are contemplated, including square, circular, and ovate shapes, one example of which is illustrated in FIG. 19.

As shown, the linkage arm 16 can include a base 30, and the linkage arm 16 and base 30 are generally flat, low-profile members configured to be situated and movably supported on a floor surface. The linkage arm 16 and base 30 may be integrally formed, or may be separate components as in other implementations described herein. The linkage arm 16 and base 30 may include on their lower surfaces wheels, roller balls, low friction sheets or coatings, or any other suitable element to reduce friction and enable movement.

The linkage arm 16 can be connected (in some examples, via the base 30) to a lower end of the pedestal 12 and extends between the pedestal 12 and a fixed member (not shown), which can include the floor surface, a wall panel, wall, or other suitable structure. The linkage arm 16 can be pivotally mounted to the fixed member. In the illustrated example, the linkage arm 16 is mounted to the fixed member by a pin 34 that secures one end of the linkage arm 16 to the fixed member while the opposite end of the linkage arm 16 remains free to pivot. The linkage arm 16 can slide across the floor surface and pivots about an axis X defined by the vertical extent of the pin 34. The linkage arm 16, pedestal 12, and work surface 14 can pivot about the pin 34 at least 90°, and in some examples can pivot 180° or more. While the illustrated example shows a pin, the pin could instead be any other suitable attachment means that enables pivotal movement of the linkage arm.

Figure 3B:
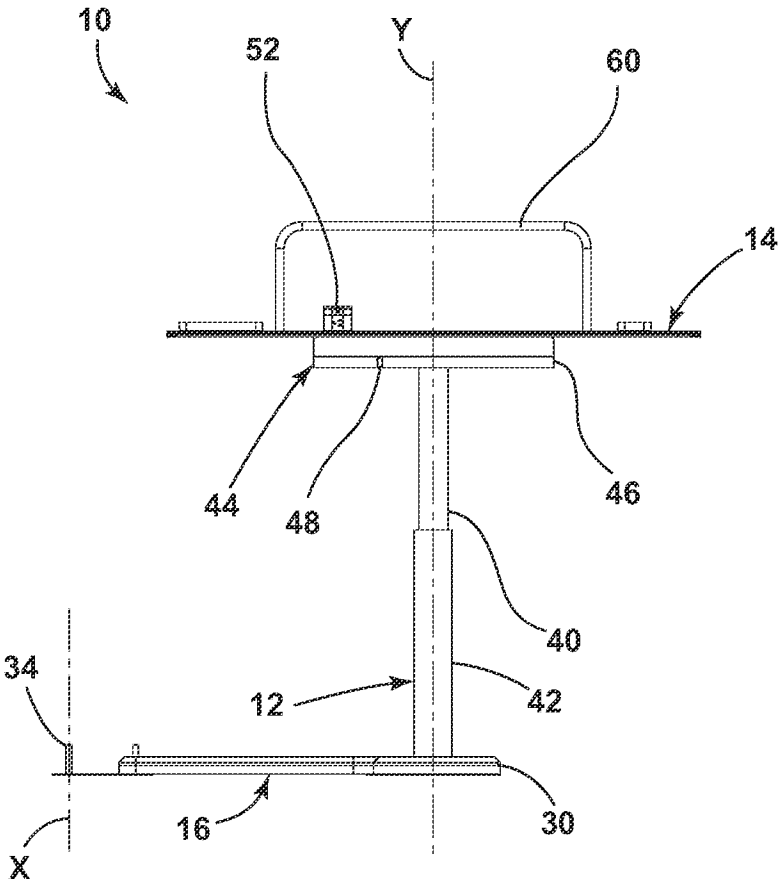
FIG. 3B is a front view of the work station, illustrating the work station positioned at a raised height.
Figure 3A:
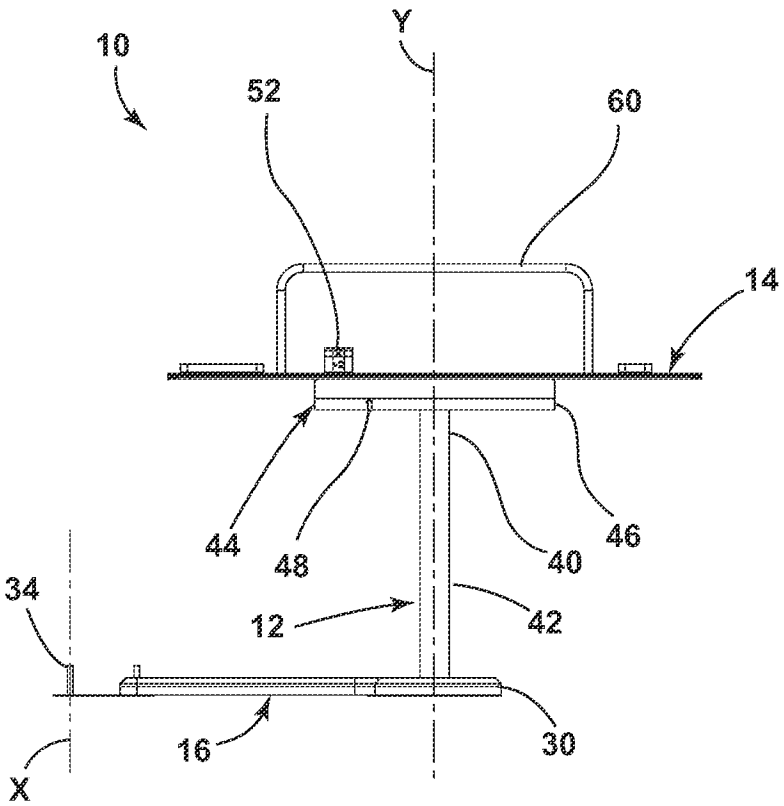
FIG. 3A is a front view of the work station, illustrating the work station positioned at a lowered height.

The pedestal 12 can extend upward from the base 30 and may be provided at a fixed height or may be height adjustable. In the case that the pedestal is height adjustable, the pedestal 12 can be telescoping and can include fixed first and extending second telescoping sections 40 and 42 so that the length of the pedestal 12 can be adjusted, as illustrated in FIGS. 3A and 3B. The telescoping section 42 enables the user to raise and lower the work surface 14 to accommodate standing or sitting positions, as well as to provide smaller adjustments to accommodate an individual user's height. Though not shown, the pedestal 12 may include a conventional manual crank, electric motor, springs, gas assist, or any other mechanism capable of manual or powered actuation. Further, the work station 10 can include a control 50 to control or effect the raising and lowering of the work surface 14.

The work surface 14 can be rotated in a substantially horizontal plane about an axis Y defined by the vertical axis of the pedestal 12. According to one example illustrated in FIGS. 3A and 3B, the work surface 14 can be rotatably mounted to the pedestal 12 by a Lazy-Susan type turntable bearing assembly 44. The bearing assembly 44 can be mounted between the lower surface 22 of the work surface 14 and the pedestal 12. A mounting plate 46 may be affixed atop the pedestal 12 and the bearing assembly 44 can be affixed to the mounting plate 46 and to the lower surface 22 of the work surface 14. The bearing assembly 44 enables the work surface 14 to be rotated at least 180°. Additionally, the work surface 14 can include a locking mechanism 48 to lock the work surface 14 in a rotational orientation as selected by the user. The locking mechanism 48 can prevent unintentional rotation of the work surface 14. The work surface 14 can be mounted to the pedestal 12 by other suitable rotatable mounting mechanisms, and the locking mechanism can comprise any suitable lock capable of selectively locking the work surface position relative to the pedestal. Alternatively, the work surface 14 may be non-rotatable with respect to the pedestal 12.

The work station 10 can include a variety of accessories or additional components. For example, the work station 10 can include integrated technology elements, such as power, data, visual displays, and the like. A power outlet and/or data port 52 can be mounted to the work surface 14, either above or below the work surface. Associated cables, electrical cords, and the like can be routed through or along the linkage arm 16, up at least a portion of the pedestal 12, and to the work surface 14. These elements can be accessible above the work surface 14 by passing through an opening or other aperture (not shown) in the work surface 14 or by extending around the perimeter of the work surface 14. Optionally or alternatively, the cables and cords can terminate below the work surface 14 in the instance where the outlet and/or port 52 are mounted below the work surface 14.

The work station 10 described herein is useable in a number of different positions, orientations, heights, and/or configurations. The work station 10 can be pivoted about the pivot pin 34 to different positions, the work surface 14 itself can be rotated to different orientations, and the height of the work surface 14 can be adjusted such that the work station 10 is selectively positionable in multiple use positions. These described adjustments/movements may be independent of one another.

Figure 1:
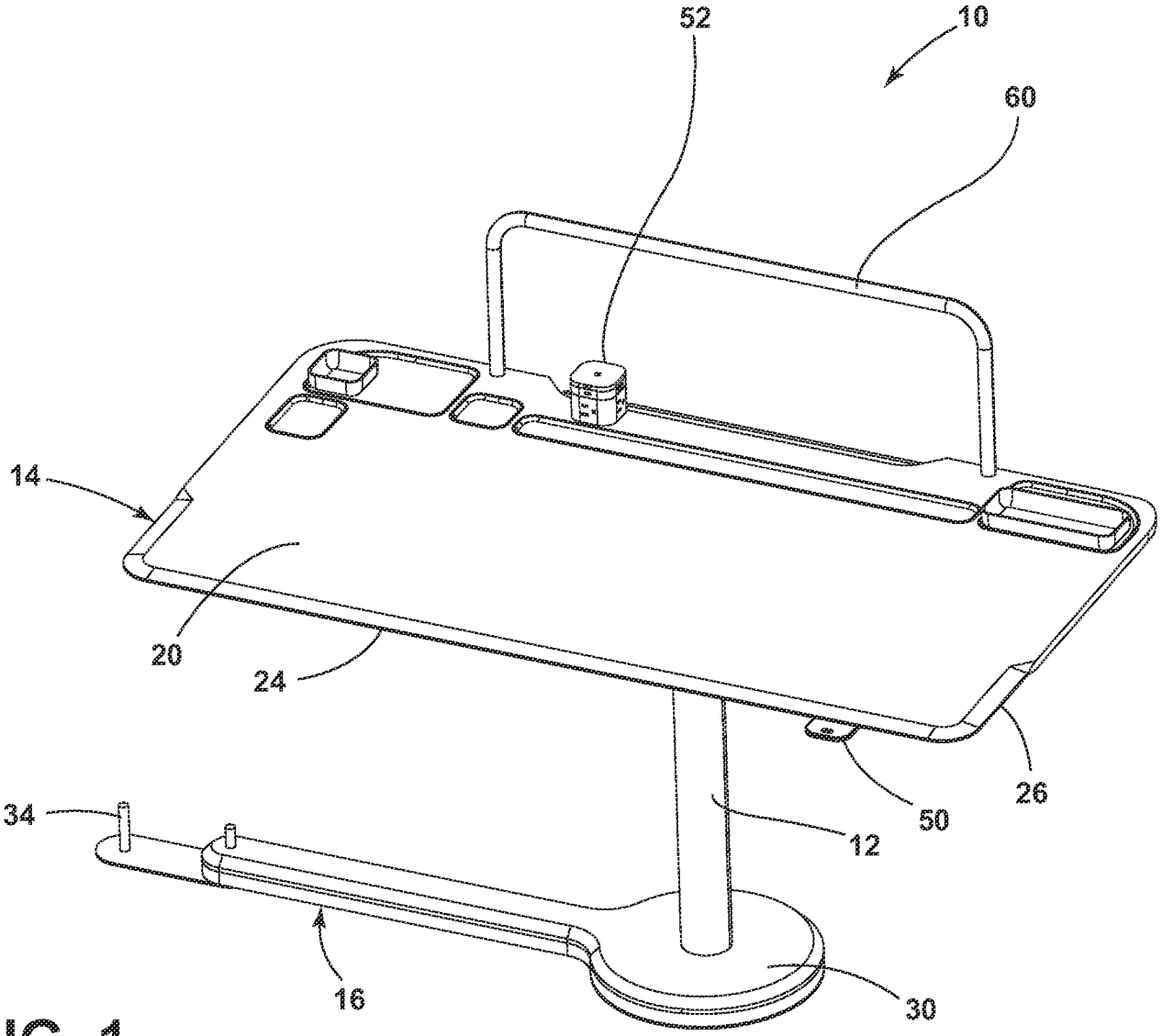
FIG. 1 is a perspective view of a work station according to one embodiment.
Figure 2:
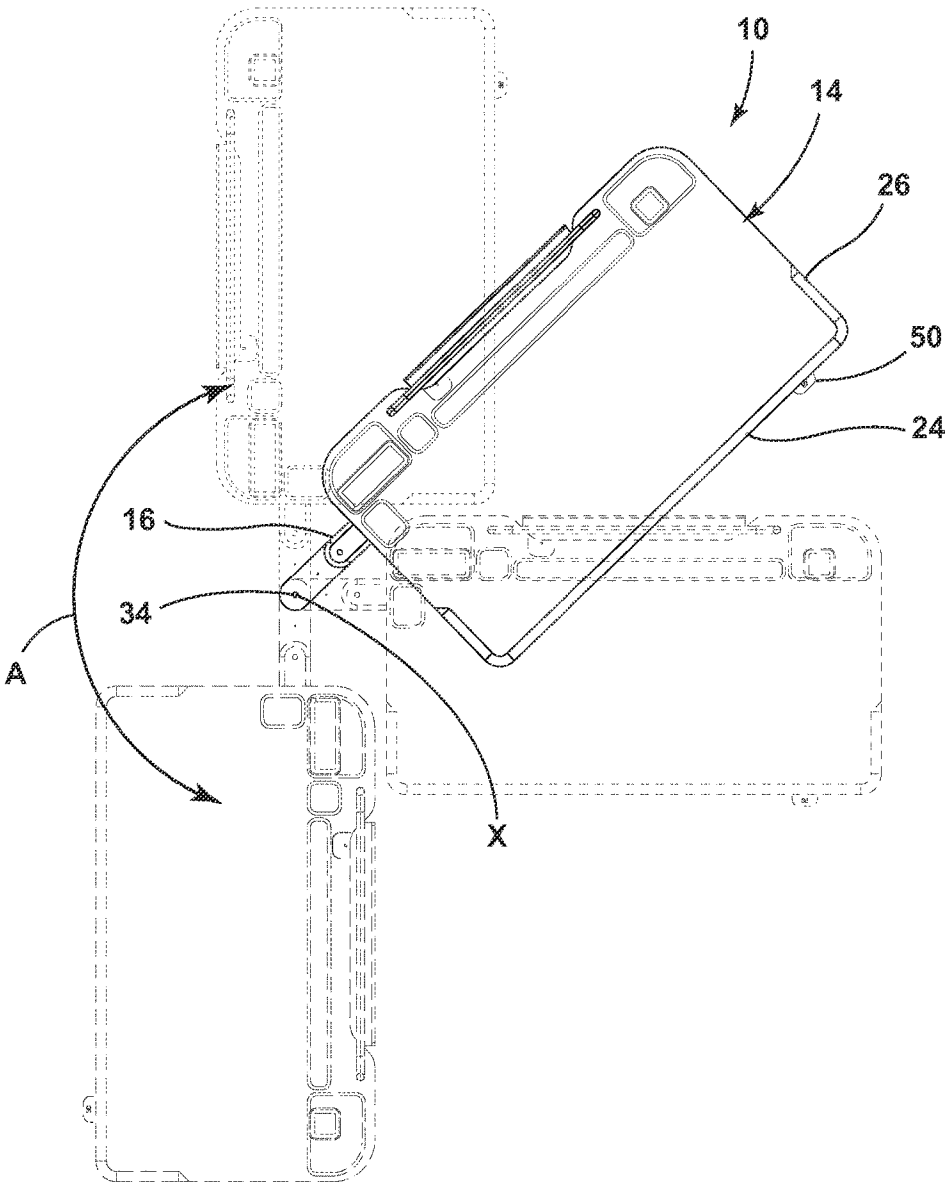
FIG. 2 is a top view of the work station, illustrating various pivoted positions of the work station.

Referring to FIG. 2, the work station 10 can be pivoted about the pivot pin 34, along an arc A. To pivot the work station 10 from one position to another, the user simply pushes the work surface 14, pedestal 12, or linkage arm 16 to slide the base 30 (and the aforementioned components) along the floor surface to the desired position. The work station 10 can be pivoted about the pivot pin 34 at least 90°, and in some implementations can be pivoted 180° or more.

Figure 4:
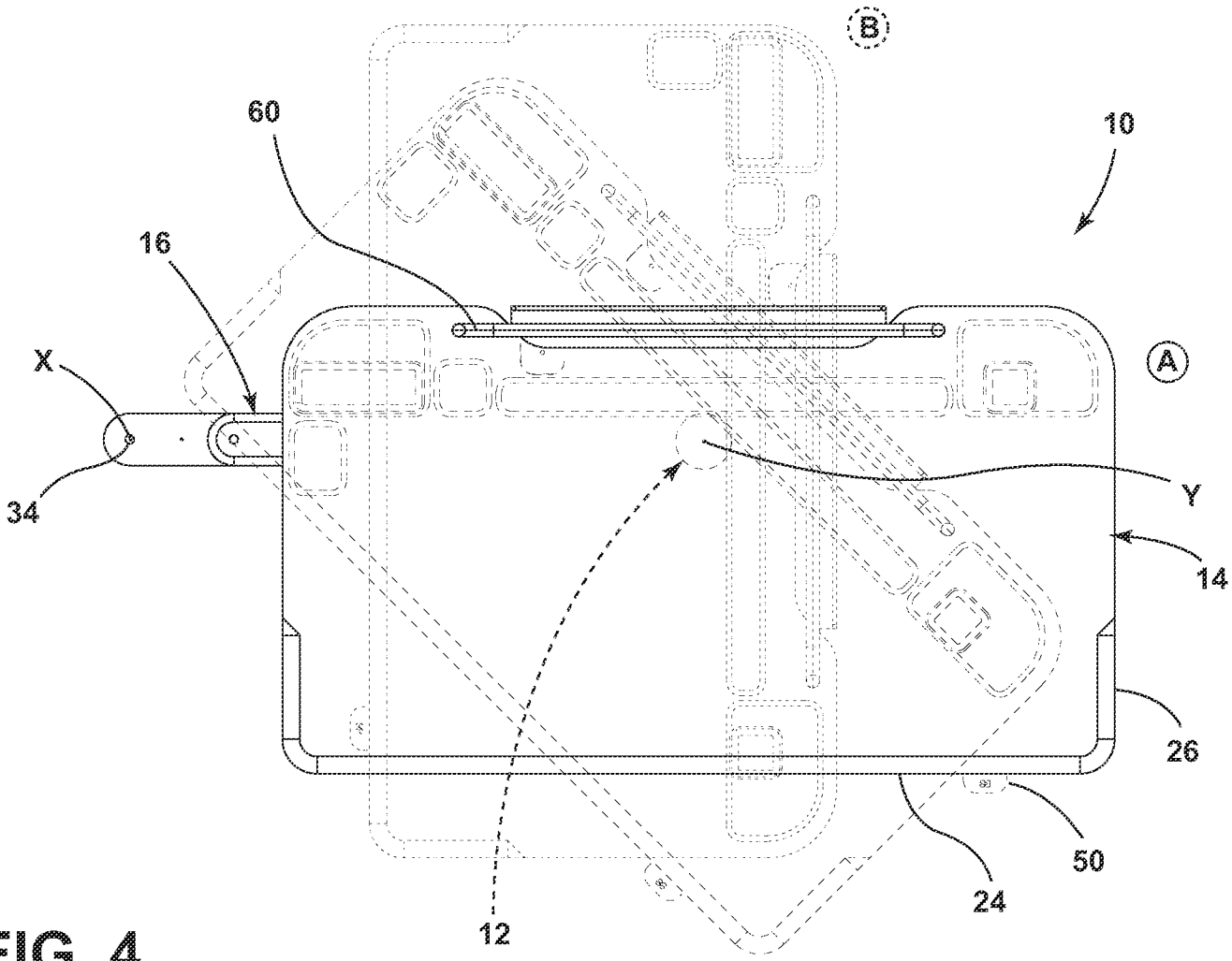
FIG. 4 is a top view of the work station, illustrating various rotated orientations of a work surface of the work station.

The work surface 14 may be rotated 180° or more, up to and including 360°, thus enabling the user to orient the work surface 14 either lengthwise or widthwise as desired. Referring to FIG. 4, the rotational orientation of the work surface 14 generally defines a first orientation A and a second orientation B, which are substantially 90° relative to one another. Further, the work surface 14 can be rotated to substantially any intermediate orientation. To rotate the work surface 14 from one orientation to another, the user unlocks the locking mechanism 48 and simply rotates the work surface 14 about the Y axis to the desired orientation. The locking mechanism 48 can be automatically or manually re-locked once in the desired orientation, thereby preventing the work surface 14 from unintentionally moving during use, etc. Notably, the rotational orientation of the work surface 14 (in orientations A, B or any intermediate orientation) can be independent of the pivotal positioning of the work surface 14 and work station 10 along an arc A.

The work surface 14 can be raised or lowered as desired. The user can adjust the height of the work surface 14 to accommodate his or her particular seated or standing height, or to move the work station 10 between a sitting posture height, as illustrated in FIG. 3A, and a perched or standing posture height, as illustrated in FIG. 3B. To adjust the height of the work surface 14, the user activates the height adjustment mechanism (not shown) associated with the pedestal 12 via control 50 if the adjustment mechanism is a powered mechanism. The height adjustment of the work surface 14 is independent of the pivotal positioning and rotational orientation described above.

Optionally or alternatively, the pivotal positioning of the work station 10 and the rotational orientation of the work surface 14 may be linked. As the linkage arm 16 pivots about the pivot pin 34 on arc A, the work surface 14 can rotate simultaneously, thus maintaining the orientation of the work surface 14 relative to the linkage arm 16. The work surface 14 can include a locking mechanism that can be unlocked—either automatically or manually—so that the work surface 14 can rotate while the work station 10 is pivoted.

Figure 5:
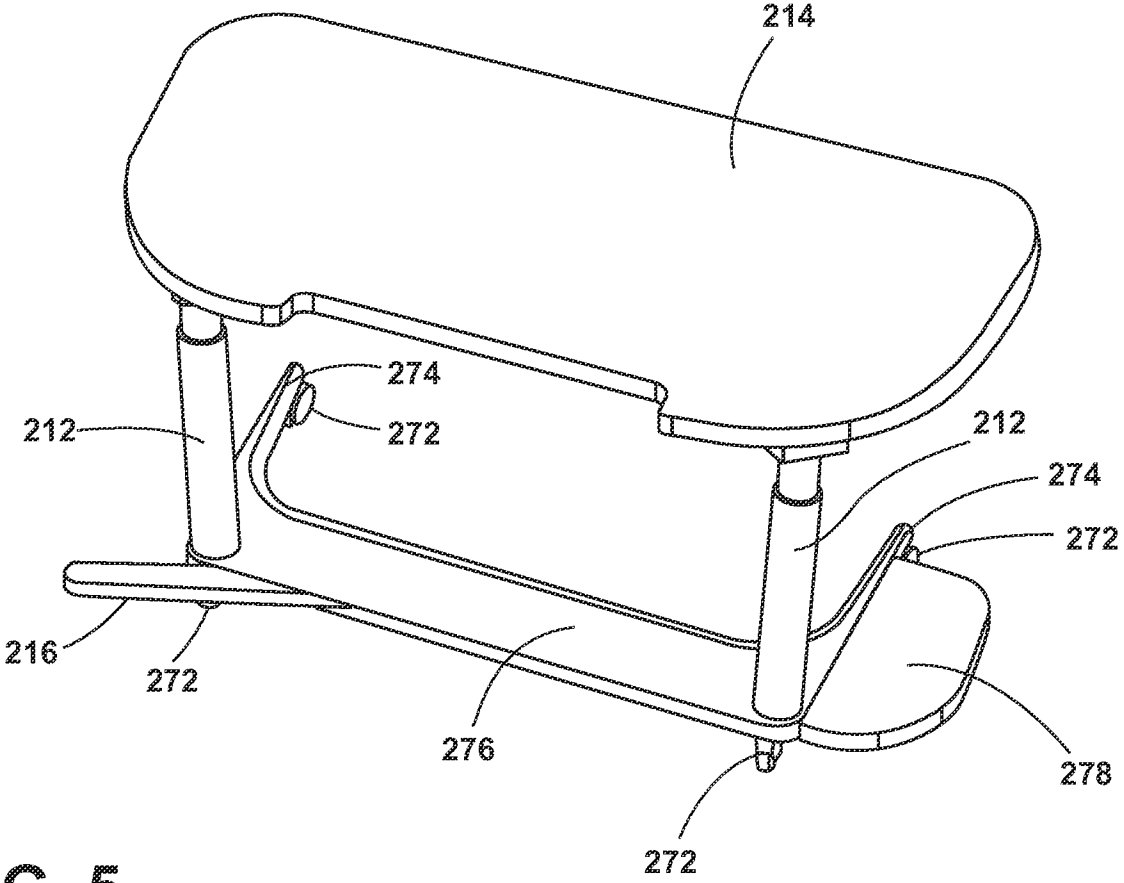
FIG. 5 is a perspective view of a work station including a linkage arm according to another embodiment.

An alternate work station 210 is shown in FIG. 5, in accordance with another embodiment of the disclosure. For purposes of brevity, descriptions of similar elements are not repeated here, and like elements are identified with like numerals increased by 200. This exemplary work station 210 includes two pedestals 212, an elongated base 270 extending between and connecting the spaced pedestals 212, and the linkage arm 216. The elongated base 270 can also include caster wheels 272, roller balls, low friction sheets or coatings, or any other suitable element to reduce friction and enable movement. The elongated base 270 includes support legs 274 that extend horizontally from the distal ends of the elongated base 270 and the wheels 272 can be affixed below all four "corners" of the elongated base 270. The elongated base 270 defines an upper surface 276 and the linkage arm 216 can be pivotally affixed to the elongated base 270, for example below the upper surface 276. Accordingly, the linkage arm 216 includes pivotal connections at both ends—at one end to the fixed member and at the other end to the elongated base 270.

Given the described arrangement, the linkage arm 216, elongated base 270, pedestals 212, and work surface 214 can pivot about the fixed member to change the pivotal position of the work station 210 and the elongated base 270, pedestals 212, and work surface 214 can rotate about the end of the linkage arm 216 to change the rotational orientation of the work surface 214. Optionally, the pedestals 212 may be telescoping or may be provided at a fixed height. Further optionally, a shelf 278 (or two) or other accessories can be mounted to either (or both) legs 274 of the elongated base 270 to provide a support surface that rotates/pivots with the elongated base 270. For example, a CPU could be placed upon the shelf 278 to allow the CPU and its cabling to move with the work surface 214 to simplify cable management for the work station 210. Associated cables, electrical cords, and the like can be routed through or along the linkage arm 216, through the elongated base 270, and up at least a portion of the pedestal 212 to the work surface 214.

Figure 6:
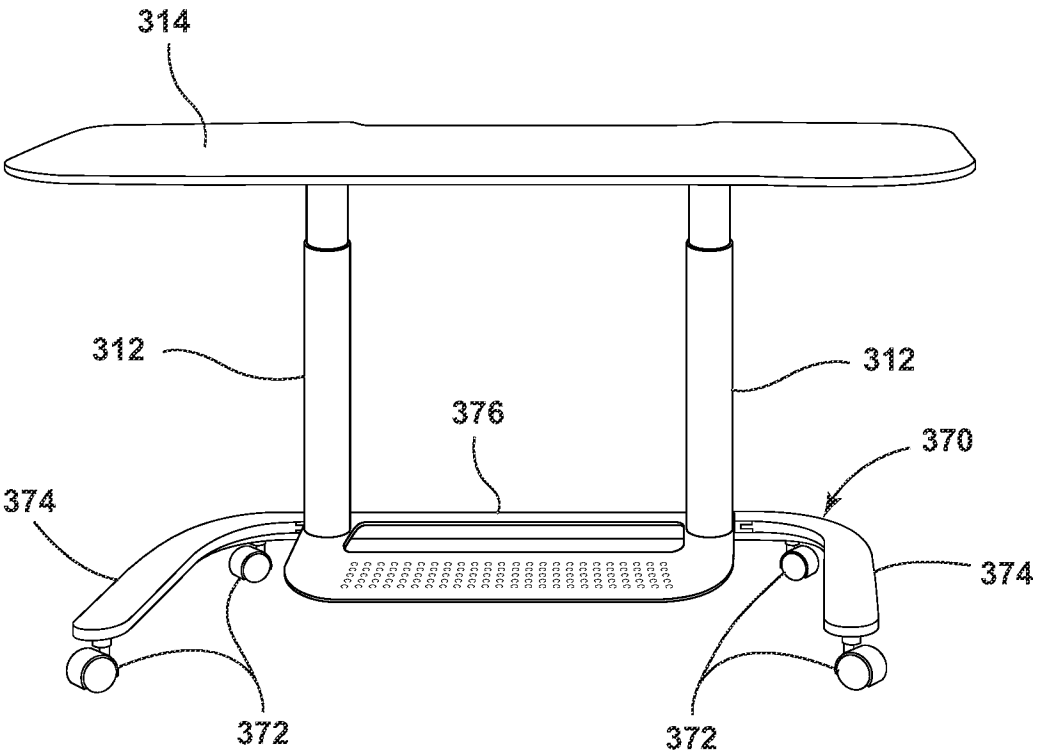
FIG. 6 is a front perspective view of a work station including a sliding linkage mechanism according to yet another embodiment.
Figure 7:
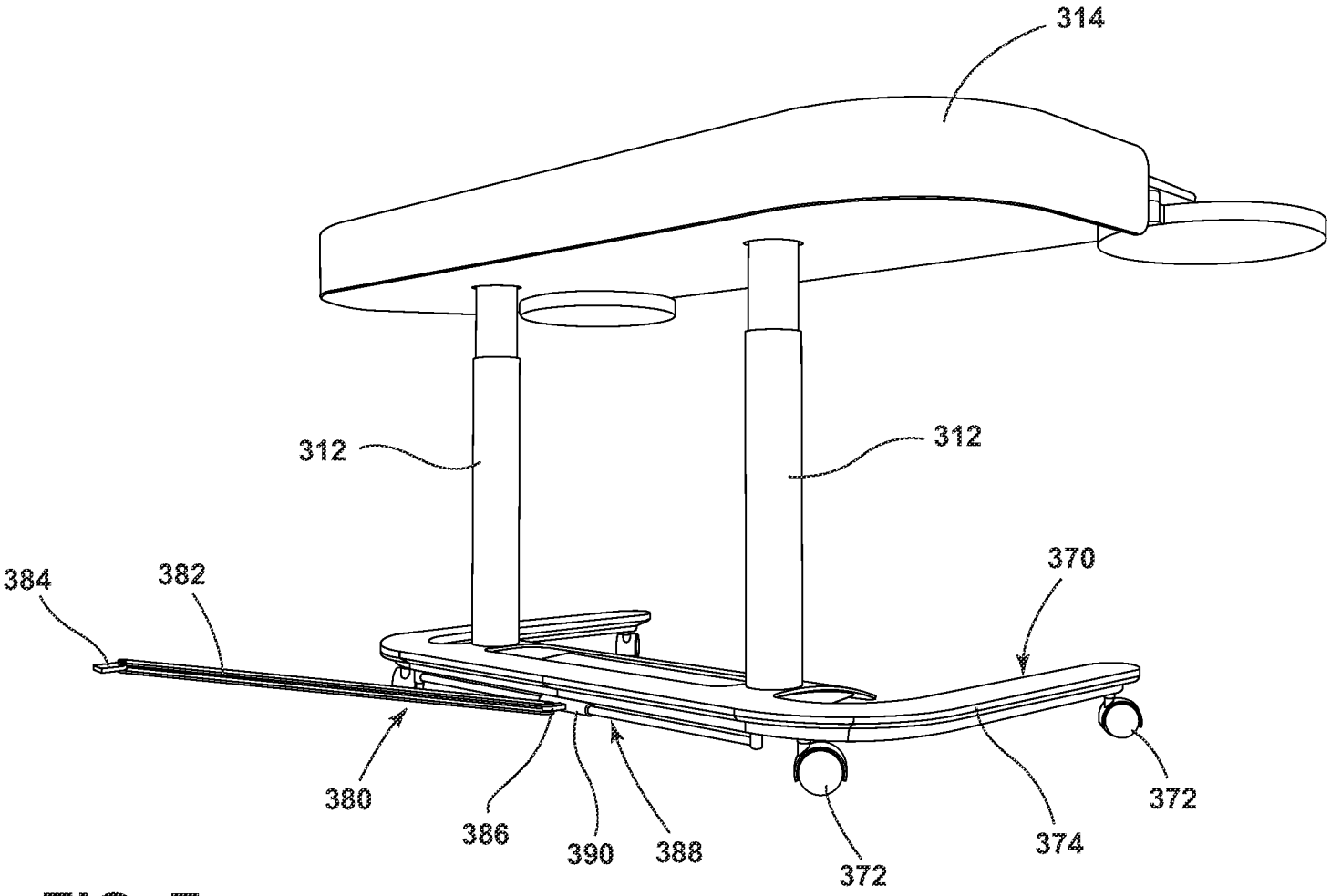
FIG. 7 is a rear, side perspective view of the work station of FIG. 6.
Figure 8A:
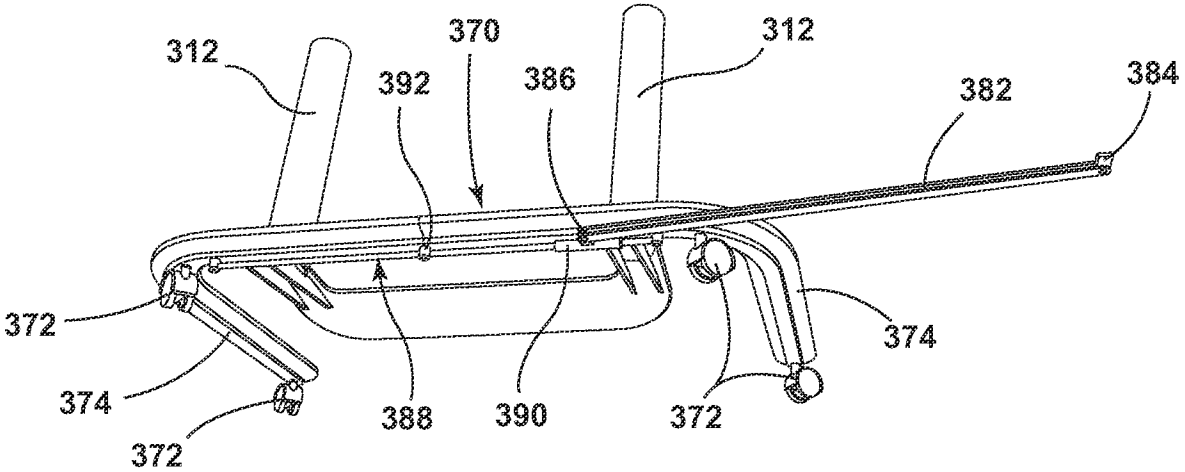
FIGS. 8A and 8B are bottom views of the lower portion of the work station of FIG. 6, illustrating different positions of the sliding linkage mechanism during movement of the work station.
Figure 8B:
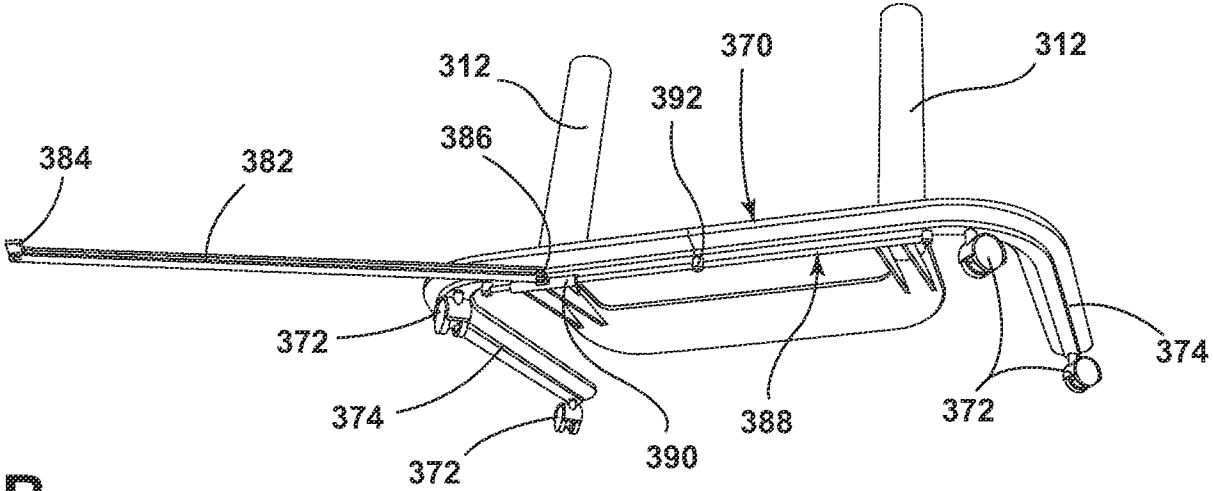

An alternate work station 310 is shown in FIGS. 6-8, in accordance with another embodiment of the disclosure. For purposes of brevity, descriptions of similar elements are not repeated here, and like elements are identified with like numerals increased by 300. This exemplary work station 310 includes two pedestals 312, the elongated base 370, and a sliding linkage arm mechanism 380. The sliding linkage arm mechanism 380 includes a sliding linkage arm 382 having first and second ends 384, 386 and a slide rod 388. The slide rod 388 is affixed to the elongated base 370, for example below the upper surface 376 of the base 370. The sliding linkage arm 382, at its second end 386, can be mounted to the slide rod 388 by a carrier 390 that is slidably affixed to the slide rod 388. The first end 382 of the sliding linkage arm 382 can be pivotally attached to the fixed member, wall, floor, etc. The slide rod 388 can extend substantially the entire length of the elongated base 370 and can include a midpoint stopper 392. The position of the midpoint stopper 392 may be adjustable along the slide rod 388 to increase or decrease the length along which the carrier 390 is free to slide. Additionally, the carrier 390 may be mounted on either side of the stopper 392 to provide left or right applications for the pivot of the work station 310.

The sliding linkage arm 382 includes pivotal connections at both ends—at the first end 384 to the fixed member and at the second end 386 to the elongated base 370, via the carrier 390 and slide rod 388. Additionally, the sliding linkage arm 382 may slide along the slide rod 388 to increase the range of motion of the work station 310. Given this arrangement, the work station 310 can pivot about the fixed member to change the pivotal position of the work station 310, can rotate about the second end 386 of the sliding linkage arm 382 to change the rotational orientation of the work surface 314, and the work station 310 can increase or decrease the distance between the fixed member and the elongated base 370 to provide increased range of motion of the work surface 314, as will be described in greater detail below. Associated cables, electrical cords, and the like can be routed through or along the sliding linkage arm 382 and can be fastened to the linkage arm 382 prior to reaching the carrier 390. The cable can transition from the sliding linkage arm 382 to the slide rod 388 with a small amount of slack to allow for the linear movement of the carrier 390. The cable can be routed to and fastened on the elongated base 370 prior to being routed up the pedestal 312, to a power strip, or elsewhere.

Optionally, the pedestals 312 may be telescoping or may be provided at a fixed height. Further optionally, a shelf 378 (or shelves) or other accessories can be mounted to either (or both) legs 374 of the elongated base 370 to provide a support surface that rotates/pivots with the elongated base 370. For example, a CPU could be placed upon the shelf 378 to allow the CPU and its cabling to move with the work surface 314 to simplify cable management for the work station 310.

Figure 9:
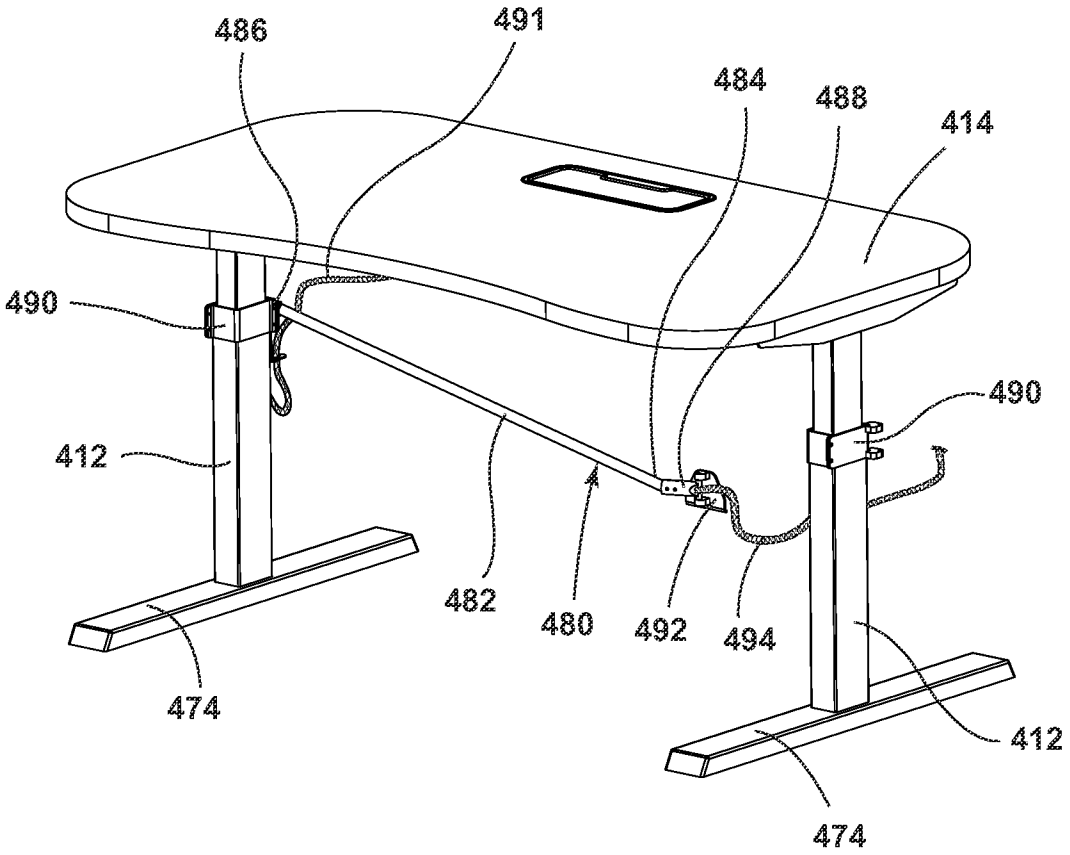
FIG. 9 is a perspective view of a work station including a tether mechanism according to another embodiment.
Figure 10:
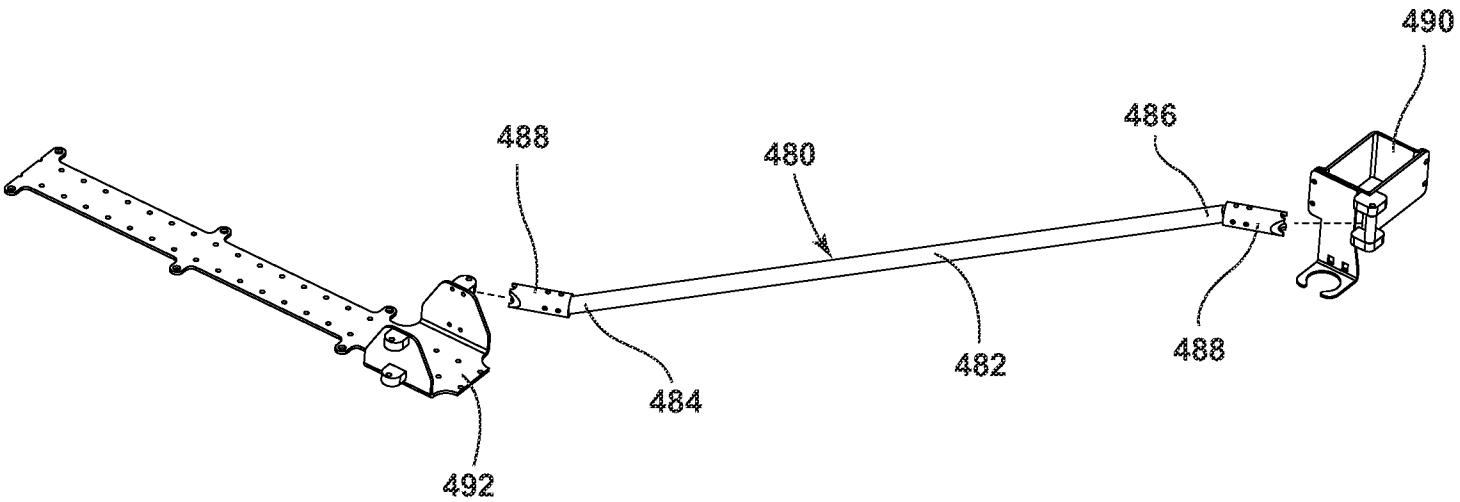
FIG. 10 is an exploded view of the tether mechanism.
Figure 11:
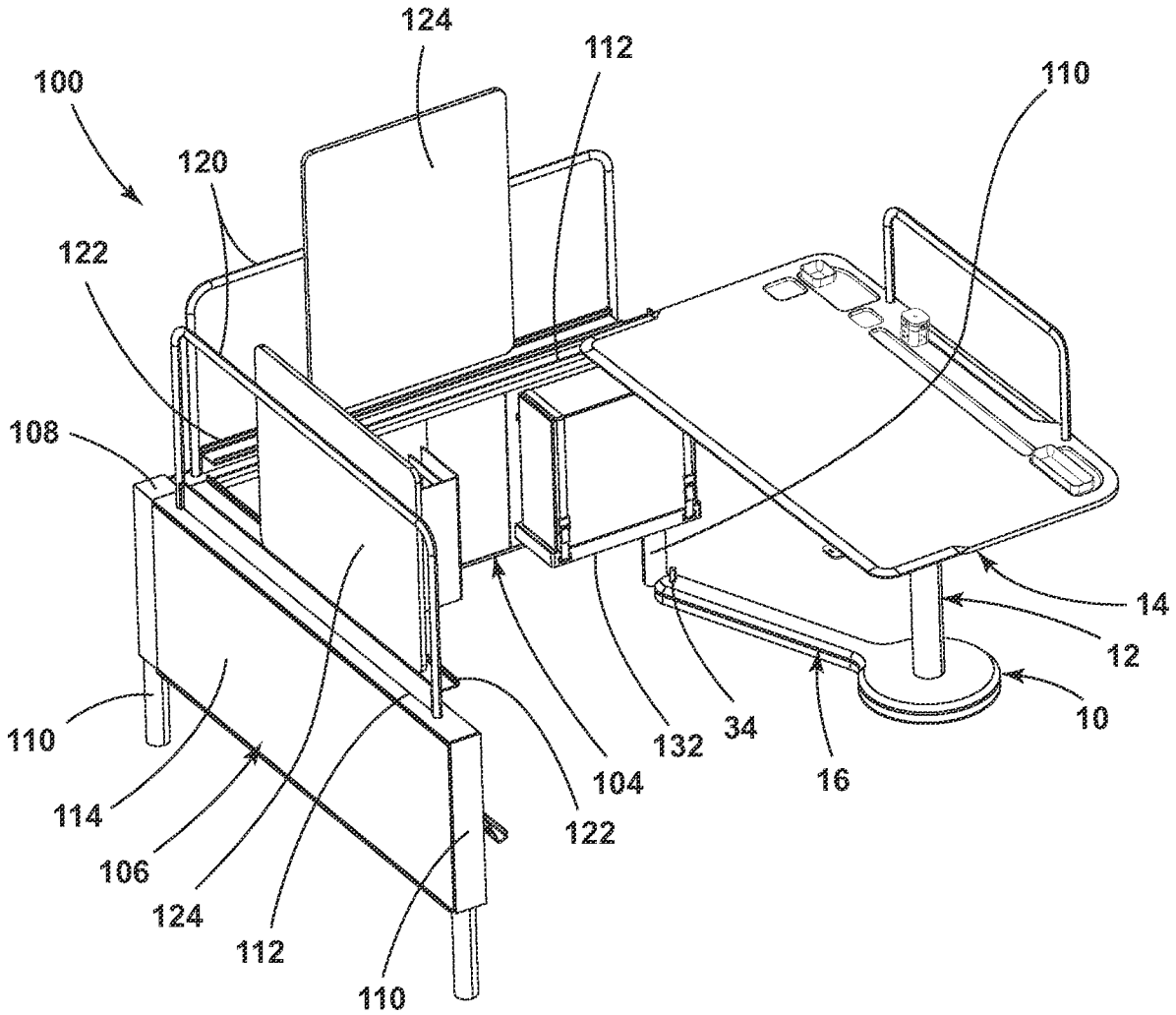
FIGS. 11 and 12 are perspective views of a work space, including a work station, according to another embodiment.
Figure 12:
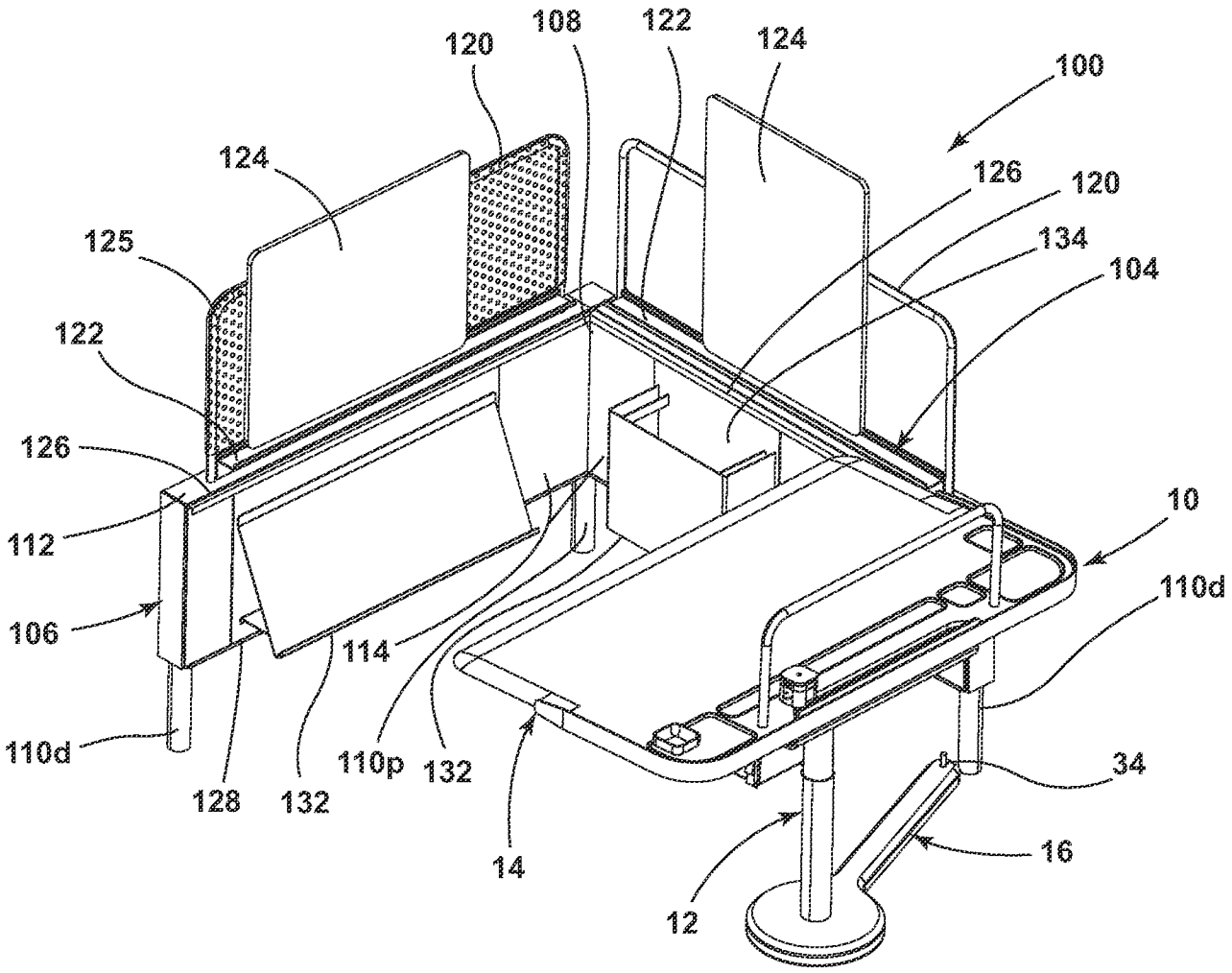

An alternate work station 410 is shown in FIGS. 9-10, in accordance with another embodiment of the disclosure. For purposes of brevity, descriptions of similar elements are not repeated here, and like elements are identified with like numerals increased by 400. This exemplary work station 410 includes two spaced legs 474 on and two pedestals 412, and optionally may include casters. The work station 410 further includes a tether mechanism 480 instead of a linkage arm. The tether mechanism 480 includes a generally flexible tether 482 that may be made of rubber, elastomeric, a silicon-like material, or any other suitable material with a degree of stretch. The tether 482 acts as a shock absorber, thus preventing items on the work surface from being knocked over as the work station 410 is moved to the extent of the tether 482. The tether 482 has first and second ends 484, 486, and each end includes a connector 488 configured to receive a clevis pin (not shown) or similar fastener. The tether mechanism 480 also includes two attachment brackets 490 and 492. Leg bracket 490 can be affixed to one of the pedestals 412 and includes through holes to also receive a clevis pin or similar fastener. Panel bracket 492 can be mounted to the fixed member, such as a wall panel as will be described in greater detail below, and includes through holes to receive a clevis pin or similar fastener. A connector 488 is received in each one of the brackets 490, 492 to pivotally attach the tether 482 at the first end 484 to the panel bracket 492 and the second end 486 to the leg bracket 490, using a clevis pin or other type fastener. Accordingly, the tether 482 is pivotally fixed at both ends—the first end 484 to the fixed member and the second end 486 to the work station pedestal 412. The pivotal attachment of the work station 410 to the fixed member, via the tether mechanism 480, enables the pivotal position and rotational orientation of the work station 410 to be changed as desired by the user. As will be discussed in greater detail below, the length of the tether 482 is predetermined and configured to appropriately limit the travel of the work station 410.

Associated cables 494, electrical cords, and the like can be routed along the tether mechanism 480. The cable 494 can extend beyond the first and second ends 484, 486 of the tether 482 to make the desired connections, and the cable 494 is provided slightly longer than the length of the tether 482 so that the cable 494 is less likely to be inadvertently pulled from the electrical/data connections. The cables 494 and tether 482 may be covered in a braided jacket to add protection and for bundling multiple wires, etc. Additionally, the leg bracket 490 may include a split ring clip, or other suitable attachment feature, for retaining the cable/braided jacket to aid with cable management.

A reconfigurable work space 100 is shown in FIGS. 11-18 in accordance with another embodiment. The work space 100 generally includes first and second wall panels 104, 106 and the above described work station 10. In the example, the wall panels 104, 106 can be arranged perpendicular to one another, as is common in wall panel systems, and together they define a boundary 107 (or footprint area) and a corner 108 therebetween. Suitable connector arrangements for wall panel system, that may be used in conjunction with the work space 100, are described in more detail in U.S. Pat. No. 8,844,222, filed Sep. 9, 2011, entitled "CONNECTOR ARRANGEMENT FOR A WALL PANEL SYSTEM," the entire content of which is herein incorporated by reference. Space-dividing wall panels can be used for creating an upright wall system, which involves joinder of several panels in adjacent, aligned, and/or transverse relationship for at least partially delineating work spaces and the like.

Although there are a variety of generally standard configurations, the wall panels 104, 106 typically include a pair of spaced apart vertical frame members 110 connected at their upper and lower ends, or any location between, by a pair of spaced horizontal frame members 112. The frame members 110, 112 can support one or more cover panels 114. These cover panels 114 provide the panel system 102 with both aesthetic and functional qualities. For example, the cover panels 114 may be wrapped or otherwise covered with a decorative material or surface, and they may also provide a surface for supporting accessories as well as acoustical separation between various office spaces. In the illustrated example, the cover panels 114 do not extend all the way to the floor surface and the lower portion of vertical frame members 110 are exposed. Of course, it is contemplated that the cover tiles may extend to the floor surface and/or to the ceiling.

In the configuration illustrated in FIGS. 11-18, the wall panels 104, 106 are arranged perpendicular to one another and define a proximal vertical frame member 110*p* and distal vertical frame members 110*d*. The work station 10 is positioned, at least in some positions/orientations, within the boundary 107 (FIGS. 13-16) or footprint defined by the first and second wall panels 104, 106. The pivot pin 34 of the linkage arm 16 can be affixed to the floor surface as described above, or can be attached to one of the wall panels 104, 106. In the example illustrated in FIG. 11, the pivot pin 34 is attached to (or received within) the distal vertical frame member 110*d* of the first wall panel 104. Accordingly, the work station 10 can pivot relative to the first wall panel 104, and the work surface 14 can both rotate (about the Y axis) and raise or lower (via the telescoping pedestal 12) so that the work station 10 may be positioned in multiple use configurations at predetermined positions with respect to the boundary 107. Though not illustrated in the figures, in other implementations, the pivot pin 34 may be attached to the distal vertical frame member 110*d* of the second wall panel 106, or to either of the proximal vertical frame member(s) 110*p*.

Figure 13:
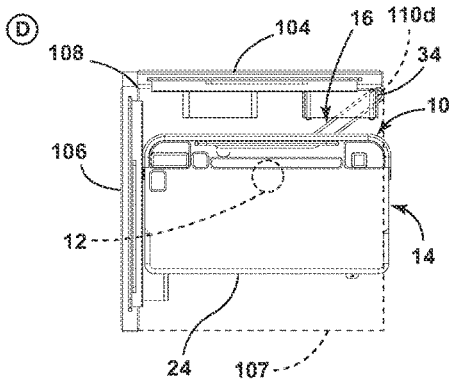
FIG. 13 is a top view of the work space, illustrating the work station in a first position.

Referring to FIGS. 13-18, several different exemplary configurations of the work station 10 and work space 100 are illustrated. The configuration shown in FIG. 13, illustrates the work station 10 attached to the distal vertical frame member 110*d* of the first wall panel 104, and disposed in a first position D. In the first position D, the linkage arm 16 is pivoted toward the corner 108 and the work station 10 is disposed substantially adjacent the corner 108. Further, in the illustrated first position D, the work surface 14 is oriented with the first perimeter side 24 parallel to the first wall panel 104. In this first position D, the work surface 14 is within the boundary 107, can be raised or lowered, and may be considered a focused work configuration.

Figure 14:
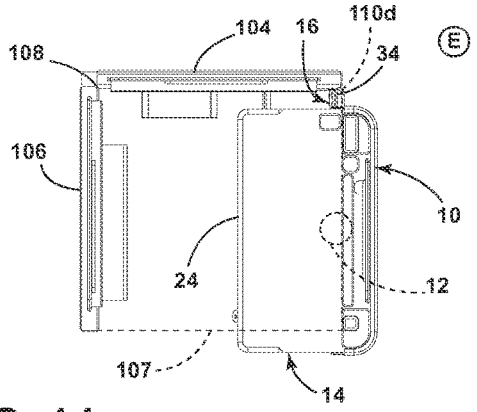
FIG. 14 is a top view of the work space, illustrating the work station in a second position.

Referring now to the configuration shown in FIG. 14, the work station 10 is disposed in a second position E wherein the work station 10 and the panels 104, 106 cooperate to form a generally U-shaped configuration. In the second position E, the linkage arm 16 is pivoted at least some distance away from the corner 108 and the work station 10 is somewhat spaced from the corner 108. Further in the second position E, the work station 10 is positioned with at least a portion thereof disposed within the boundary 107 of the first and second wall panels 104, 106. In the illustrated second position E, the work surface 14 is oriented with the first perimeter side 24 perpendicular to the first wall panel 104. The work surface 14 can be raised or lowered to either the raised or sitting height.

Figure 16:
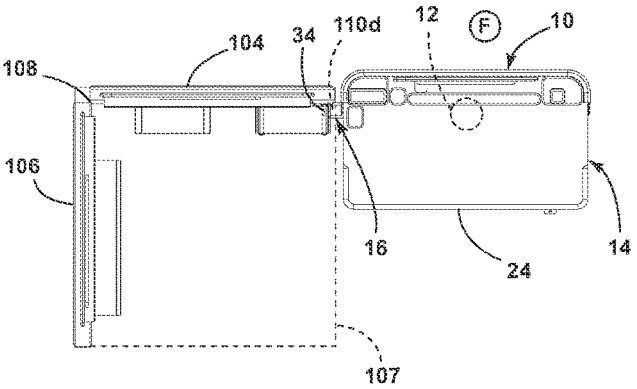
FIG. 16 is a top view of the work space, illustrating the work station in a third position.

Referring now to the configuration shown in FIG. 16, the work station 10 is disposed in a third position F. In the third position F, the linkage arm 16 is pivoted furthest away from the corner 108 and the work surface 14 is positioned outside the boundary 107 of the first and second wall panels 104, 106. In this third position F, the work surface 14 can be raised or lowered and is considered a collaborative work configuration.

The work station 10 can be positioned in any number of intermediate positions between the first and third positions D and F, and the work surface 14 can be rotated to intermediate orientations between the first and second orientations A, B. As described above, the work station 10 can be pivoted about the fixed member at least 90°, and may be adapted to pivot greater than 180°. Further, in all feasible pivotal positions, the work surface 14 can be rotated to intermediate orientations where the first perimeter side 24 is neither parallel nor perpendicular to the first wall panel 104. The described ways that the work station 10 can be adjusted, including combinations of pivotal position, rotational orientation, and/or work surface height, provide flexibility for users to configure and reconfigure their work space to be more focused or more collaborative. The reconfigurability of the work station 10 is permitted by the relative lengths of the linkage arm 16, the dimensions of the work surface 14, and the attachment point of the work station 10 with respect to the panels 104, 106, as well as their lengths. The dimensions of these elements are predetermined to enable the exemplary configurations shown in FIGS. 13-16 where the different edges of the work surface 14 are generally aligned with the sides of the boundary 107. Of course, all positions and configurations between the exemplary positions (primarily parallel and perpendicular) shown in the figures are considered as well. The work space 100 is reconfigurable and storage and other freestanding tables or accessories can be included, while providing users with full access to power and data on the work station 10.

Figure 15:
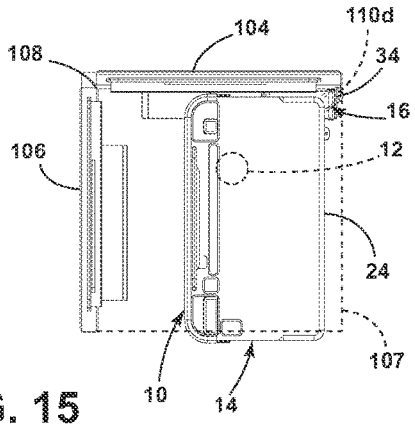
FIG. 15 is a top view of the work space, illustrating the work station in an intermediate position.
Figure 17:
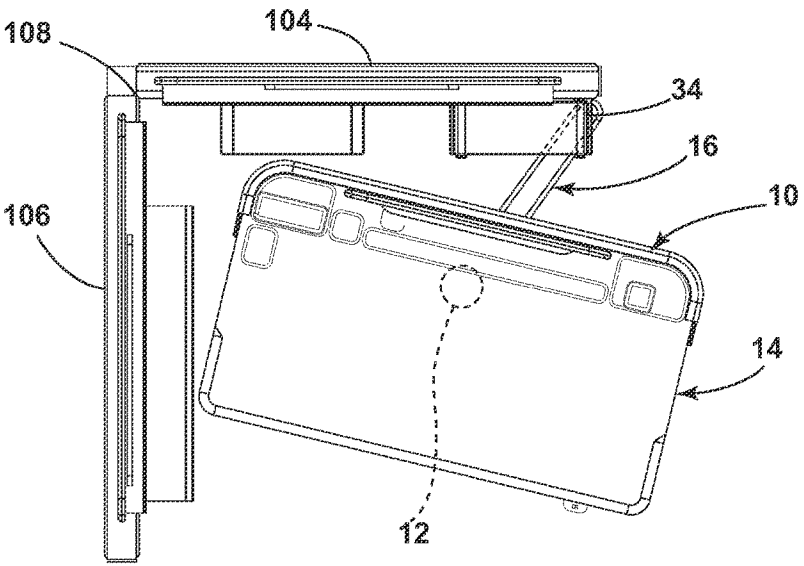
FIGS. 17 and 18 are top views of the work space, illustrating the work station in different intermediate positions.
Figure 18:
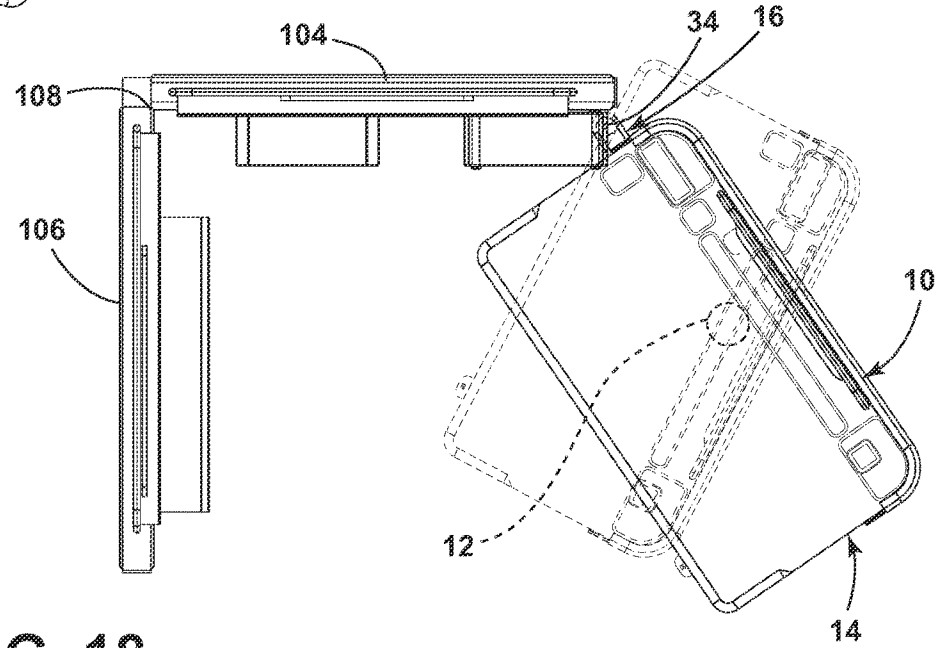
Figure 20:
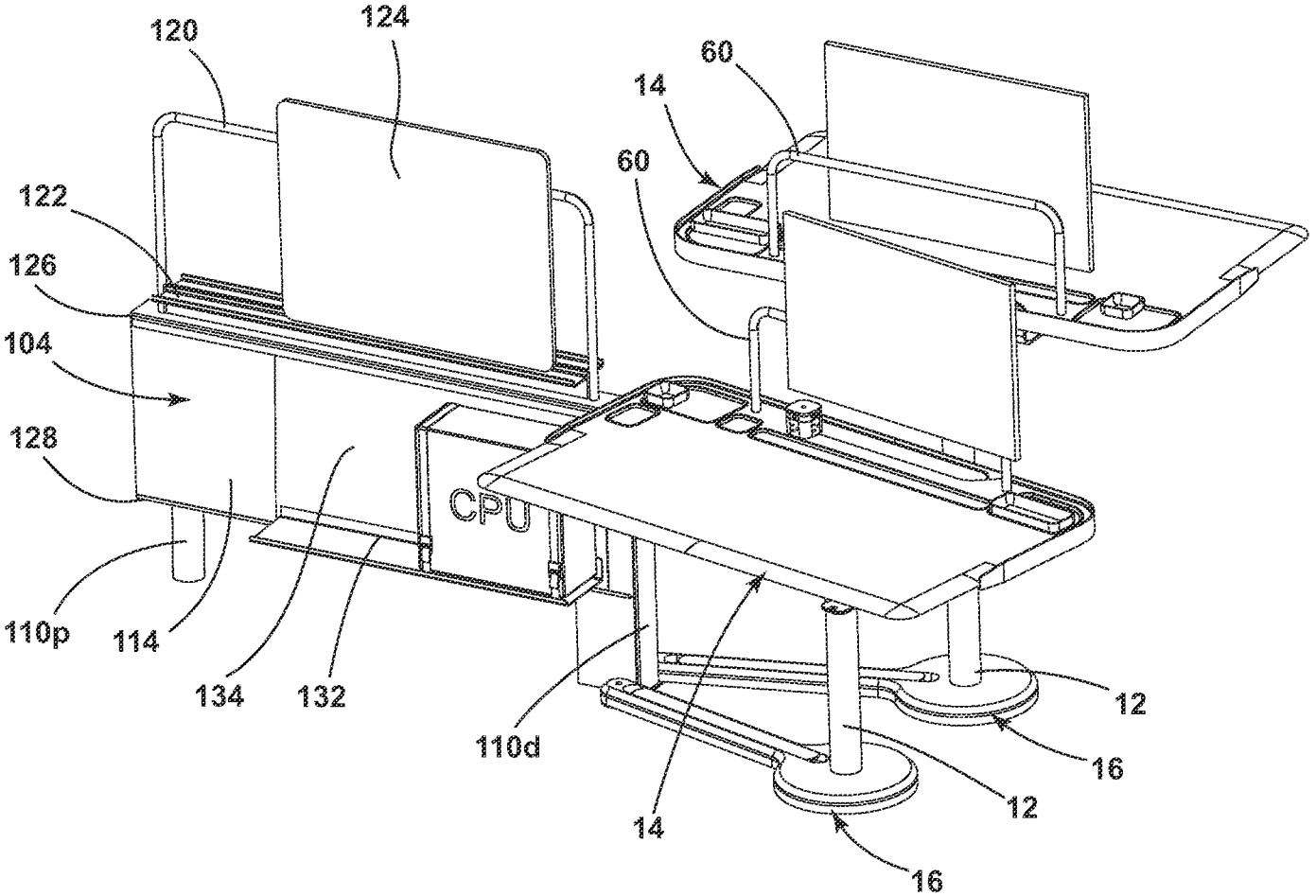
FIG. 20 is a perspective view of two adjacent work stations, illustrating two different heights and positions.

The configuration illustrated in FIG. 15, is one example of an intermediate configuration of the work station 10 and work space 100. In this exemplary intermediate configuration, the linkage arm 16 is pivoted toward the corner 108, similar to that of the first position D, and the work surface 14 is oriented with the first perimeter side 24 perpendicular to the first wall panel 104. This exemplary configuration can include either a sitting or standing height work surface 14. Other examples of intermediate configurations of the work station 10 and work space 100 are illustrated in FIGS. 17-18. FIG. 20 illustrates alternate work spaces that include only one wall panel, which is shared between the adjacent two work stations.

Each work space 100 may also include a variety of accessories, work tools, and other features, including removable privacy screens or panels. The upper horizontal frame member 112 can include a raised support bar 120 that has two vertical sides and a horizontal center spaced from the frame member 112. In the illustrated example, the support bar 120 is formed of a tube, the cross-section of which can be circular, rectangular, or any other suitable shape. An elongated track 122 can extend along the frame member 112, below the support bar 120 and one or more privacy panels 124 can be supported on the track 122 and by the support bar 120. The privacy panel 124 can include a magnet or magnets to magnetically attach the panel 124 to the support bar 120 in the instance that the support bar is metal. The privacy panels 124 can be arranged either horizontally or vertically and are adapted to be easily removed and to be easily rearranged to reconfigure the work space 100 as desired. Additionally, the privacy panels 124 can be removed from the work space 100 and taken away for use in other areas of the office, etc. Alternatively or optionally, the privacy panel 124 can include a clip or other attachment means on one surface to attach the privacy panel 124 to the support bar 120. The privacy panel 124 may have planar front and rear surfaces and can be used as wall decor and to provide privacy. Various designs are contemplated herein for the panel, including, but not limited to, matted prints or photos, screen, wallpaper, pegboard, dry-erase board, chalkboard, magnetic or cork boards, any variety of fabric, or any variety of laminates, composites, or other materials. The panels may be decorative, informative, or perform other suitable functions. Each wall panel 104, 106 can include one or more privacy panels 124 arranged as desired by the user. In one embodiment, illustrated in FIG. 12, the support bar 120 can include a mesh 125 or fabric installed over the support bar 120 to provide more privacy and/or aesthetics.

Each wall panel 104, 106 can also include an accessory mounting system that includes upper and lower mounting tracks 126 and 128. The mounting tracks 126, 128 extend the at least a portion of the length of the upper and lower horizontal frame members 112 and include spaced apart receiver channels (not shown) that open toward one another. An accessory panel 132 can include one or more accessories supported on or mounted to a planar support back 134. The accessory panel 132 can be removably retained to the wall panel 104, 106 by the upper and lower mountings track 126, 128; the support back 134 is retained between the upper and lower mounting tracks 126, 128. The accessory panel 132 can be mounted to and/or retained by the wall panel 104, 106 by any suitable means, including but not limited to a track system, magnets, clips or fasteners, etc.

The accessory panel 132 is mounted in juxtaposition to the surface of the cover panel 114, and the wall panels 104, 106 may each have multiple accessory panels 132 mounted thereto. Given this arrangement, when the accessory panel 132 is removed, the cover panel 114 is exposed, providing an aesthetically pleasing surface regardless of whether an accessory panel 132 is installed. Examples of features that may be included on the accessory panel include, but are not limited to, one or more shelves, a support shelf for a CPU, a lower storage unit, and/or other typical office storage and organizers. A variety of accessory panels 132, as well as multiple accessory panels, are contemplated herein to provide customization of the individual work space 100.

Figure 21:
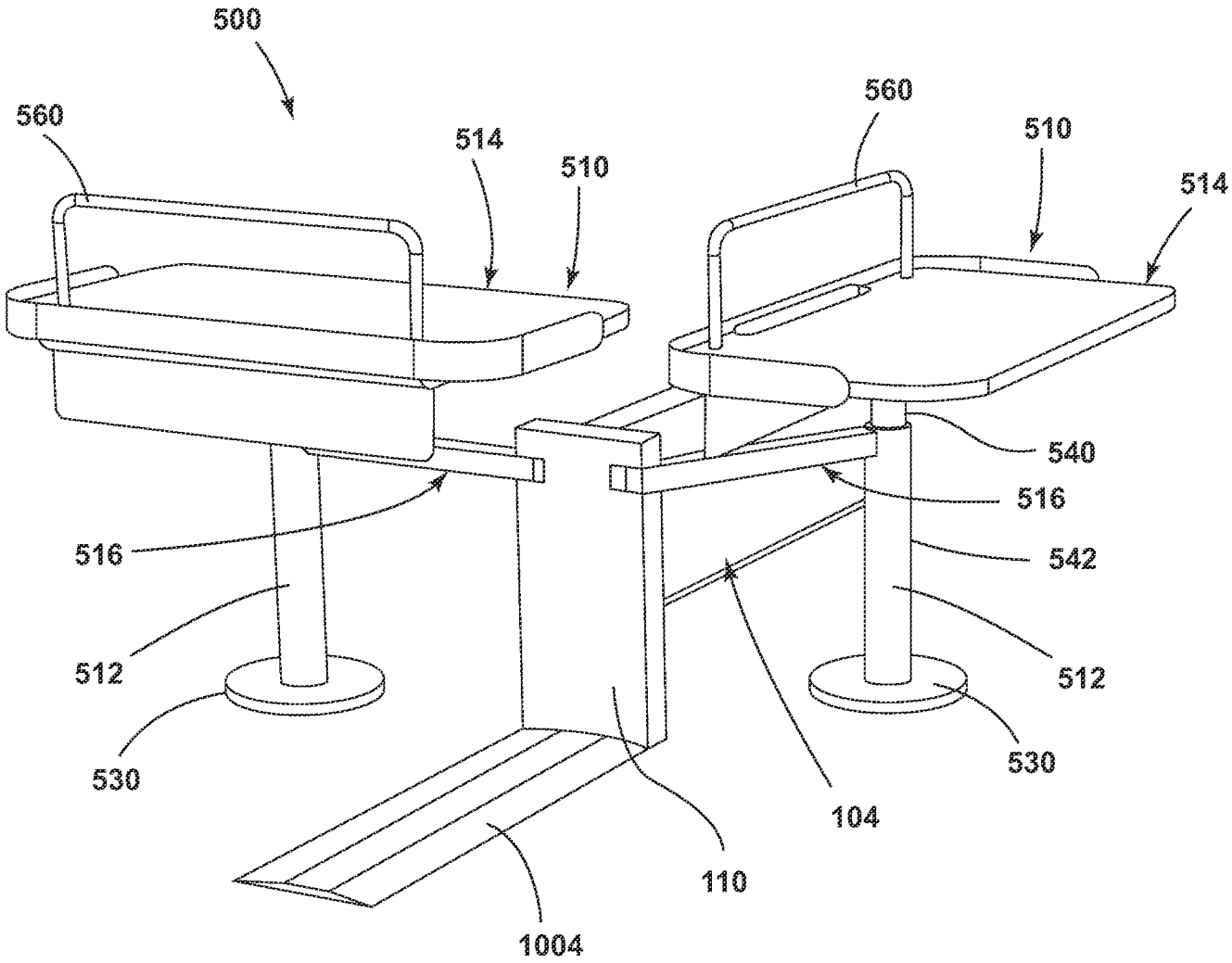
FIG. 21 is a perspective view of another embodiment of a work station including a raised linkage arm, illustrating two work stations and a partial work space.

A reconfigurable work station 510 is shown in FIG. 21 in accordance with another embodiment of the disclosure. For purposes of brevity, descriptions of similar work station elements are not repeated here, and like elements are identified with like numerals increased by 500. The illustrated embodiment includes two adjacent work stations 510 and a shared wall panel 104. The work station 510 differs in that the alternate linkage arm 516 is elevated above the floor surface and is separated from the base 530. The pivot pin 534 can be attached to (or received within) the vertical frame member 110 of the first wall panel 104. Accordingly, the work station 510 can pivot relative to the first wall panel 104. The base 530 remains supported on the floor surface, and the linkage arm 516 is attached to the lower fixed section 542 so that the height of the pedestal 512 can still be adjusted to raise or lower the work surface 514.

Figure 22B:
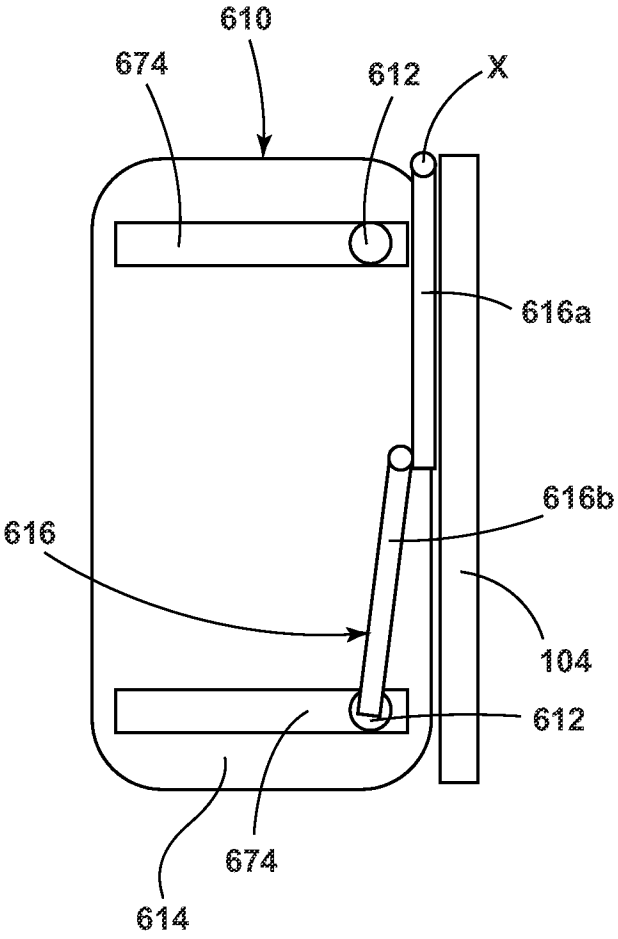
FIGS. 22A and 22B are schematic representations of another embodiment of a work station including a jointed linkage arm.
Figure 22A:
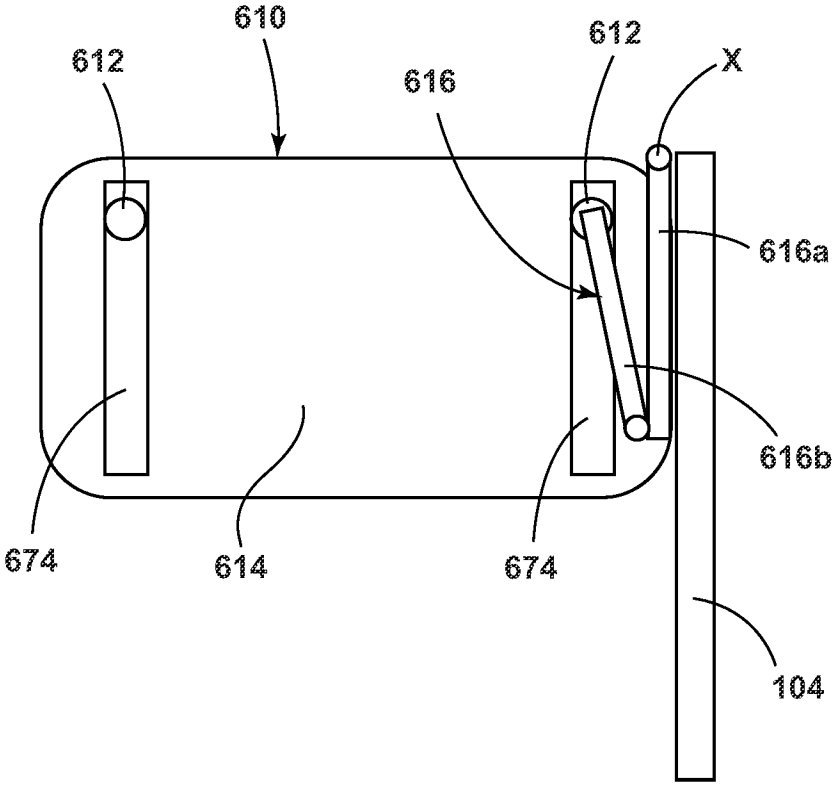
Figure 23B:
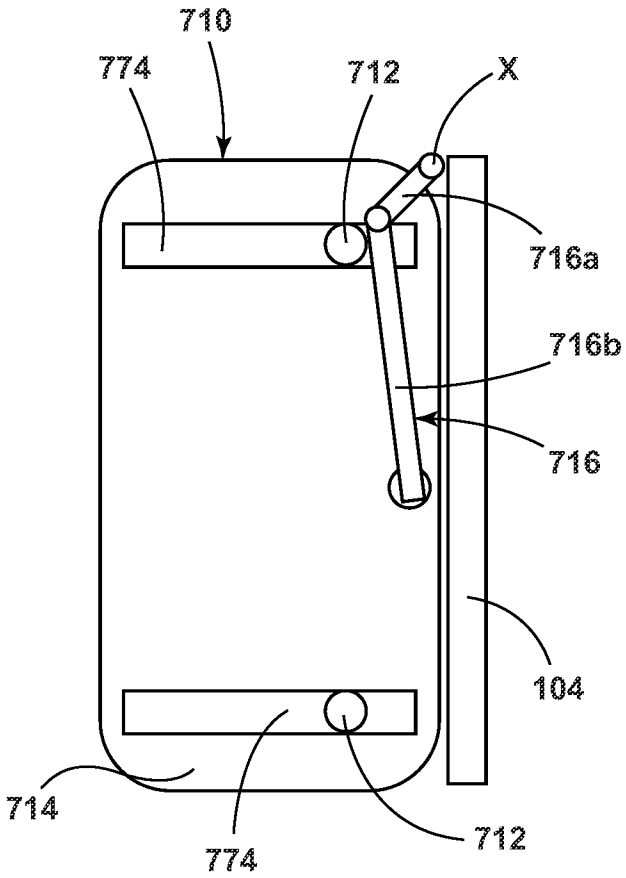
FIGS. 23A and 23B are schematic representations of another embodiment of a work station including a jointed linkage arm.
Figure 23A:
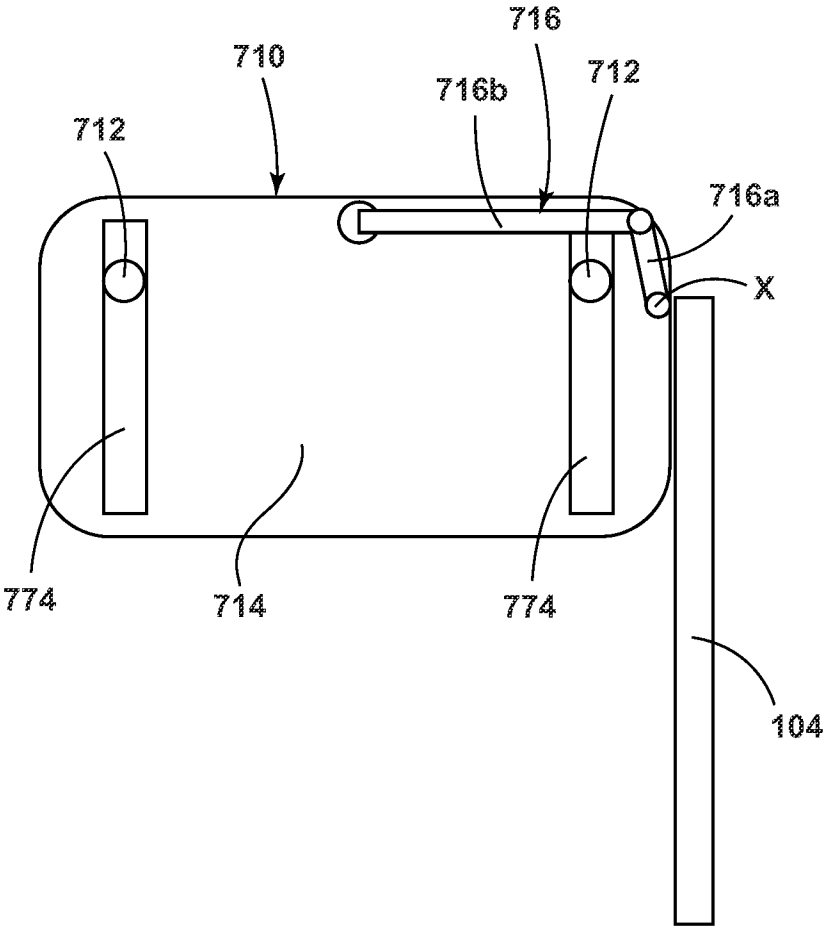

A schematic representation of an alternate work station 610 is shown in FIGS. 22A and 22B in accordance with another embodiment of the disclosure. For purposes of brevity, descriptions of similar work station elements are not repeated here, and like elements are identified with like numerals increased by 600. This embodiment includes a jointed two piece linkage arm 616. The work station 610 includes two spaced legs 674 and pedestals 612. The jointed linkage arm 616 includes a pivotal connection at both ends, as well as a pivotal connection between the two linkage arm sections 616*a* and 616*b*. Linkage arm section 616*a* is pivotally connected to wall panel 104, at or near the end of the wall panel, and linkage arm section 616*b* is pivotally connected to one of the legs 674. This embodiment is suited for joining the end or side of the work station 610 to the end of the wall panel 104 and the work station 610 can be positioned as shown in FIGS. 22A and 22B, as well as outside the work station boundary similar to positions described in previous embodiments. Another alternate work station 710 is shown in FIGS. 23A and 23B where like elements are identified with like numerals increased by 700. This embodiment includes a jointed two piece linkage arm 716 where the sections 716*a* and 716*b* are not the same length. The shorter linkage arm section 716*a* is pivotally connected to the end of wall panel 104, and the longer linkage arm section 716*b* is pivotally connected to the lower surface of the work surface 714, near the center of the first perimeter side 724. This embodiment is suited for joining the center of the work station 710 to the end of the wall panel 104 and the work station 710 can be positioned as shown in FIGS. 23A and 23B, as well as outside the work station boundary.

Figure 24A:
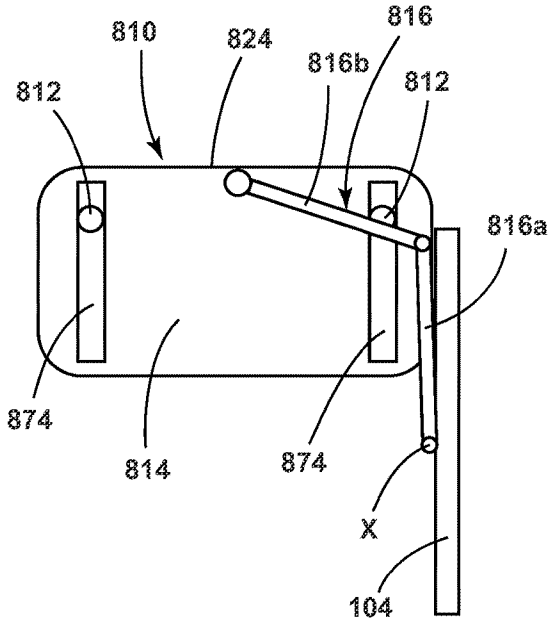
FIGS. 24A-C are schematic representations of an alternate work station including a jointed linkage arm.
Figure 24B:
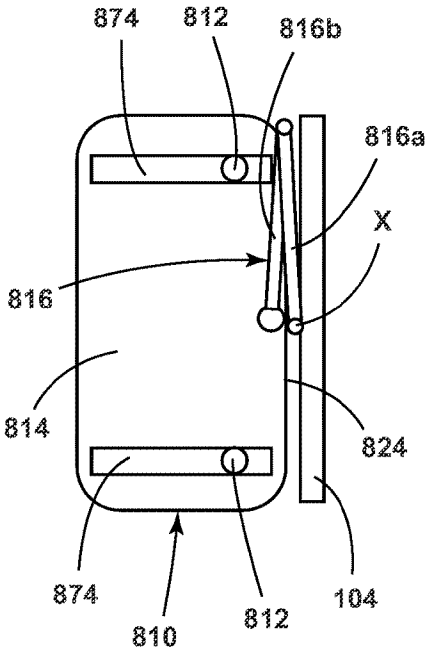
Figure 24C:
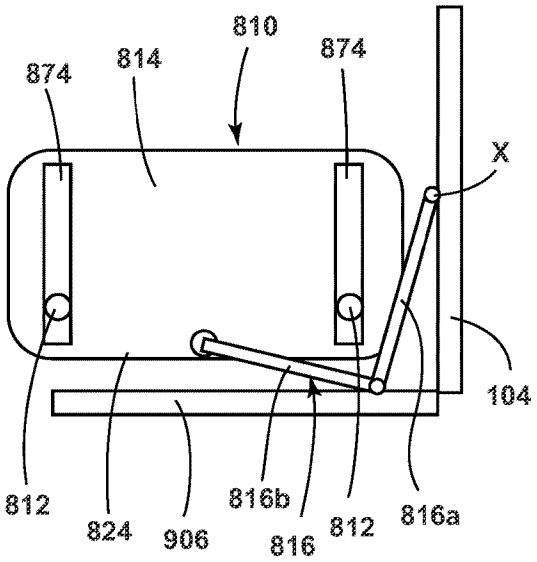
Figure 25A:
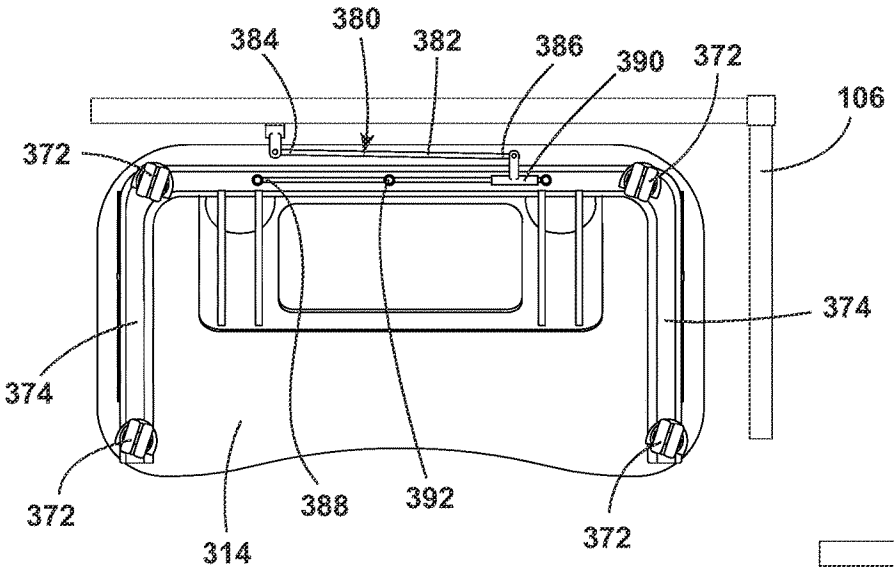
FIGS. 25A-E are bottom views of the work station and sliding linkage mechanism of FIG. 6 and a work space, illustrating the work station in different positions.
Figure 25B:
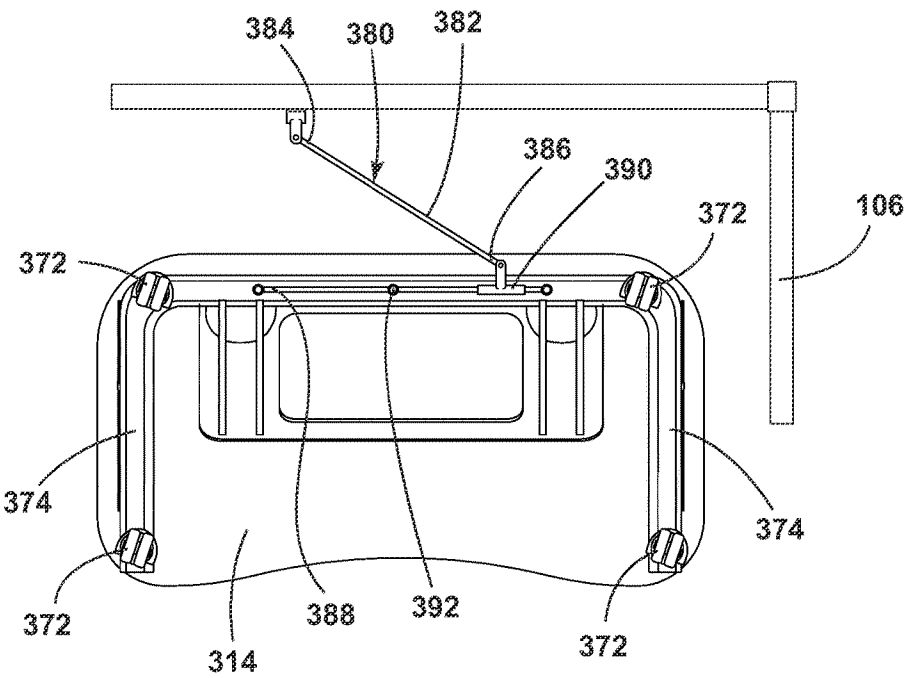
Figure 25C:
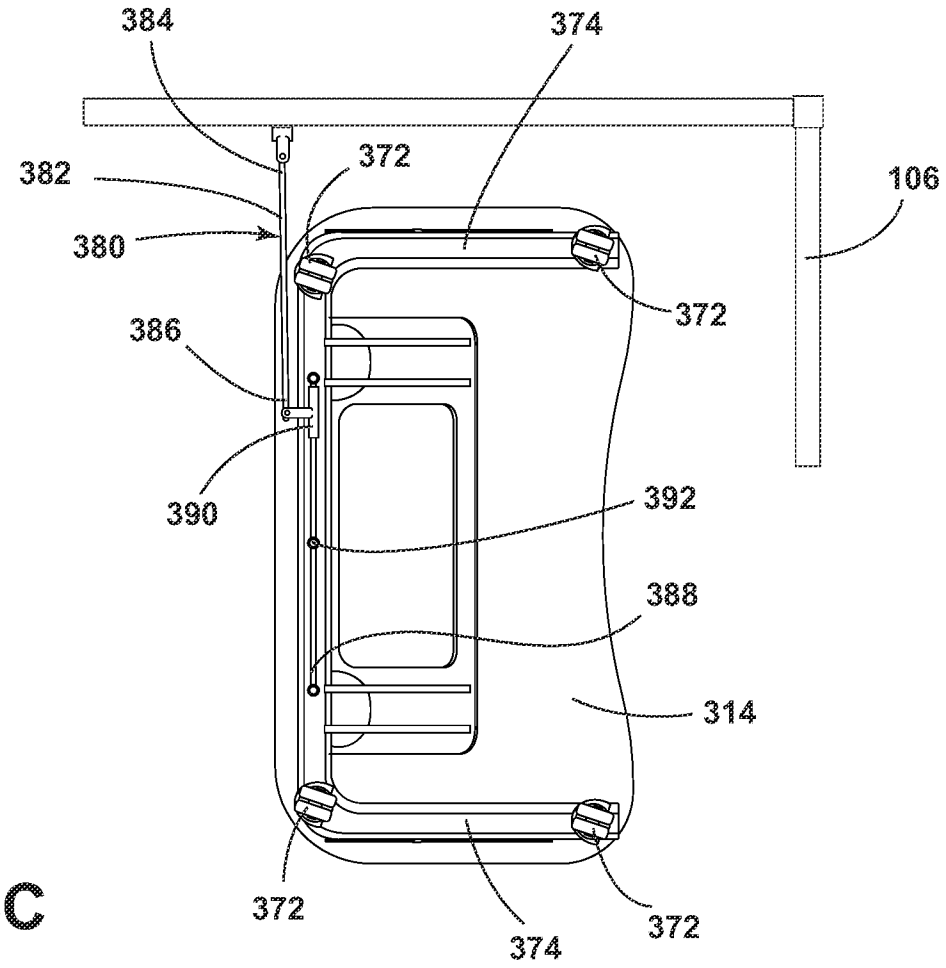
Figure 25D:
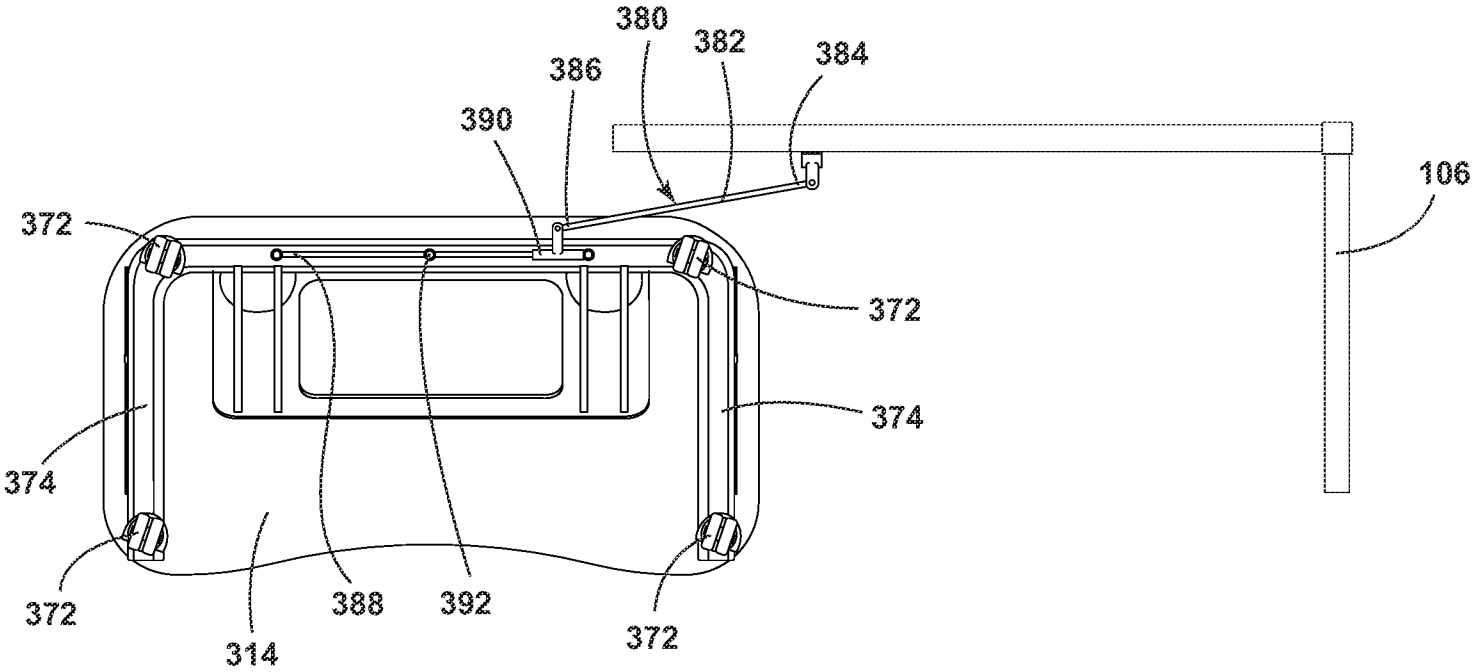
Figure 25E:
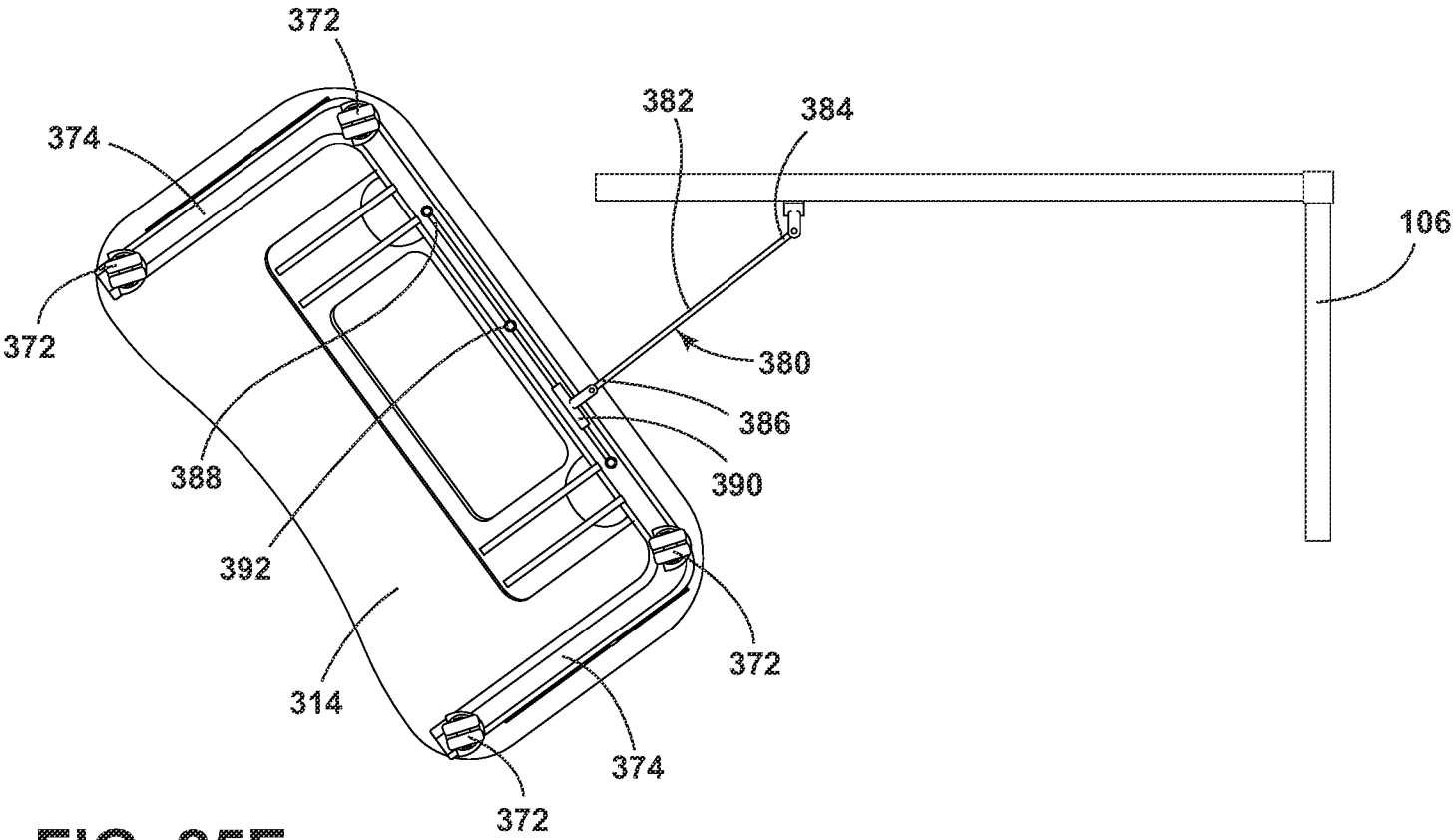

A schematic representation of an alternate work station 810 is shown in FIGS. 24A-C in accordance with another embodiment of the disclosure; like work station elements are identified with like numerals increased by 800. This embodiment includes a jointed two piece linkage arm 816 with sections 816*a* and 816*b*. Linkage arm section 816*a* is pivotally connected to wall panel 104, distal from the end the wall panel 104, and linkage arm section 816*b* is pivotally connected to the lower surface of the work surface 814, near the center of the first perimeter side 824. This embodiment is suited for joining the center of the work station 810 to the center, or at least a distance offset from the end, of the wall panel 104. The work station 810 can be positioned as shown in FIGS. 24A-C, as well as outside the work station boundary similar to positions described in previous embodiments.

Referring to FIGS. 25A-E, alternate work station 310 is shown with work space 100 in accordance with another embodiment of the disclosure in which the work station includes a sliding linkage mechanism 380 as mentioned above. For purposes of brevity, descriptions of similar work station elements are not repeated here, and like elements are identified with like numerals increased by 300. The work station 310 is shown in these figures looking up at the bottom of the work station in order to see the moving components below the elongate base 370. As discussed above, the sliding linkage mechanism 380 includes a pivotal connection at both ends of the sliding linkage arm 382—the first end 384 is pivotally connected to wall panel 104, at or near the free end of the wall panel, and the second end 386 is pivotally connected to the slide rod 388 and elongated base 370. The position of the midpoint stopper 392 can be adjusted to increase or decrease the length along which the carrier 390 can slide in order to prevent the work station 310 from hitting one of the wall panels 104, 106. Further, the carrier 390 can be mounted on either side of the stopper 392 to provide left or right applications for the pivot of the work station 310. The relative dimensions of the work station 310, wall panels 104, 106 and work space 100, attachment point of the sliding linkage mechanism 380 to the wall panel, and the length and side that the carrier 390 can travel along the slide rod 388 can be predetermined to provide the desired limited movement of the work station 310 within the work space 100. The work station 310 can pivot and rotate to be positioned as shown, as well as outside the work station boundary similar to positions described in previous embodiments.

Figure 26A:
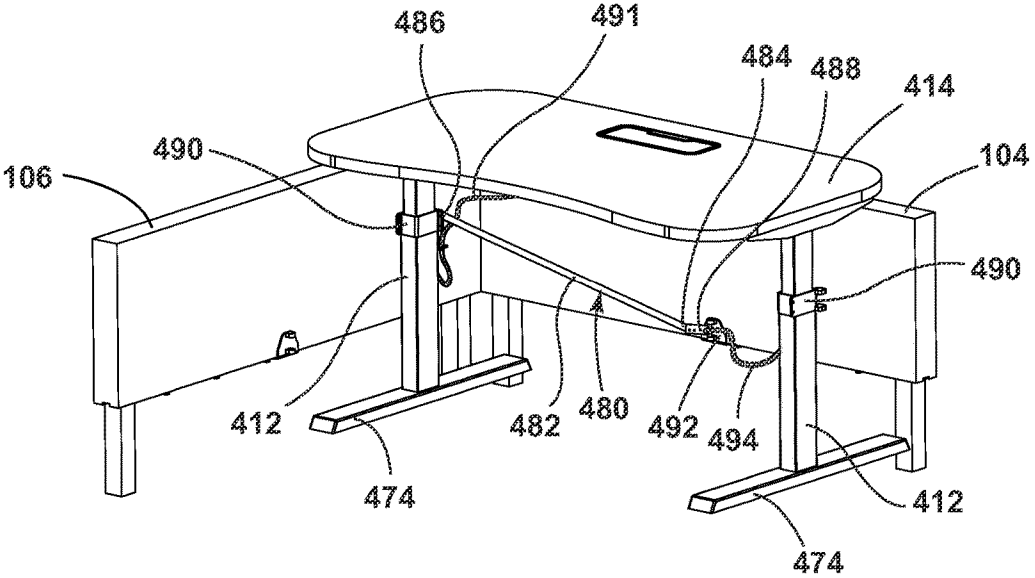
FIGS. 26A and 26B are perspective views of the work station and tether mechanism of FIG. 9 and a work space, illustrating the work station in different positions.
Figure 26B:
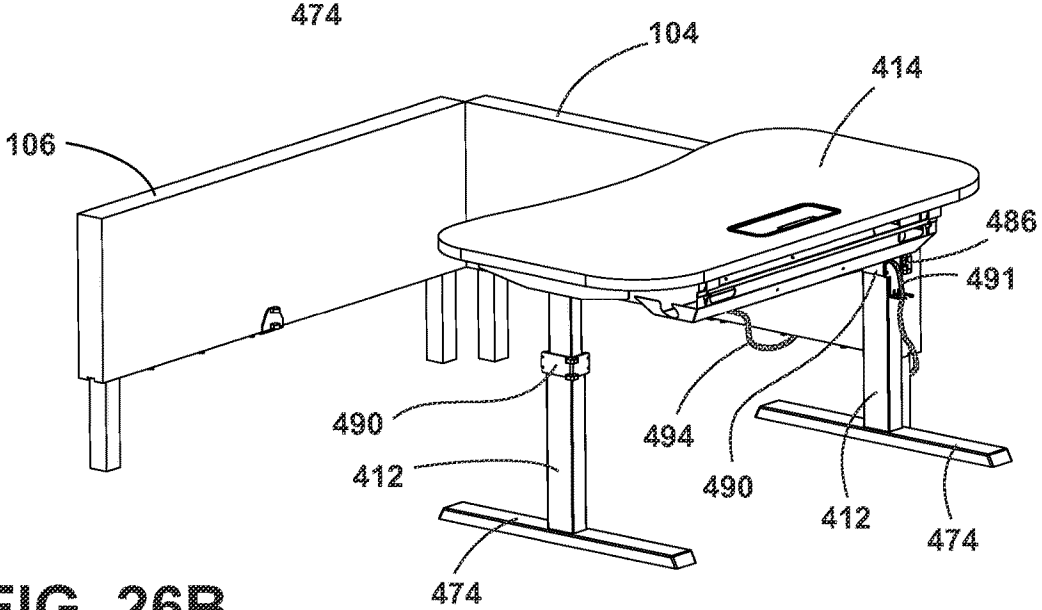

Referring to FIGS. 26A and 26B, alternate work station 410 is shown with work space 100 in accordance with another embodiment of the disclosure in which the work station includes tether mechanism 480 as mentioned above. For purposes of brevity, descriptions of similar work station elements are not repeated here, and like elements are identified with like numerals increased by 400. This embodiment is suited for joining one of the pedestals 412 of the work station 410 to the center, or at least a distance offset from the end, of the wall panel. As discussed above, the tether mechanism 480 includes a pivotal connection at both ends of the tether 482—the first end 484 is pivotally connected to wall panel 104 via panel bracket 492, and the second end 486 is pivotally connected to one of the pedestals 412 via the leg bracket 490. The generally flat, main portion of the panel bracket 492 can be installed below the lower edge of either (or both) wall panel 104, 106, with the attachment portion accessible for receiving the connector 488 of the tether mechanism 480. The length of the tether 482 can be predetermined as part of the work space 100 to appropriately limit the travel of the work station 410. More specifically, the relative dimensions of the work station 410, wall panels 104, 106 and work space 100, attachment point of the tether mechanism 480 to the wall panel, attachment point of the tether mechanism 480 to the work station 410, and the length of the tether 482 can be predetermined to provide the desired limited movement of the work station 410 within the work space 100. For example, in the configuration shown in FIG. 26A, the length of the tether 482, the location on wall panel 104 of the panel bracket 492, the size of the work surface 414 and the location of the pedestal 412 are all factored in to preventing the pedestal 412 from hitting the wall panel 106 when the work station 410 is moved to this particular configuration. These same elements allow the work station 410 to be moved and pivoted to create a U-shaped configuration, where the first perimeter side of the work surface 414 is generally aligned with the end of wall panel 104 and parallel with wall panel 106, as shown in FIG. 26B. The work station 410 can pivot and rotate to be positioned as shown, for example, as well as outside the work station boundary similar to positions described in previous embodiments.

A reconfigurable work space system 1000 is shown in FIGS. 27-33 in accordance with another embodiment of the disclosure. The work space system 1000 generally includes multiple work spaces 100 utilized to subdivide a given floor plan area in an office (or other) environment either coupled with one another or as individual, stand-alone units. Adjacent work spaces 100 can share the wall panel therebetween, or two wall panels can be positioned adjacent one another. In the shared configuration, the wall panel 104, 106 can include the above described features and components on each of its surfaces facing respective work stations. It should be understood that in any of the work space systems 1000 illustrated herein, any of the embodiments of work stations and work spaces could be utilized. The exemplary figures are shown with work station 10 and work space 100, however, each of the embodiments of work stations 200-800 could be substituted for work station 10 shown in the figures, including different combinations of work stations 10 and 200-800. Further, while each of these work station embodiments illustrate a variation for connecting the work surface to a fixed point with respect to the work space system, the connecting components for each embodiment can be appropriately sized and positioned to provide the arrangements shown in work space systems 1000.

Figure 27:
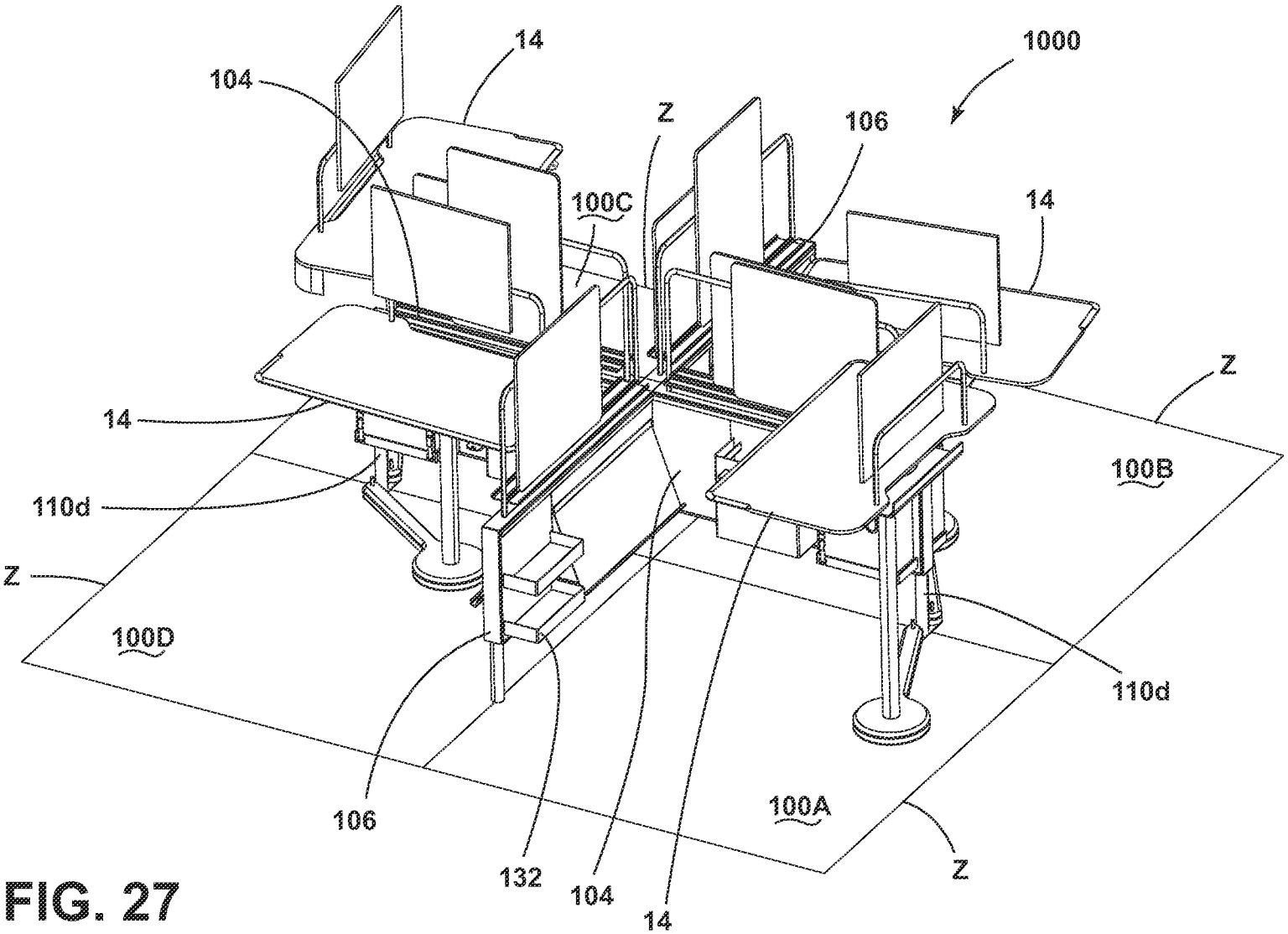
FIG. 27 is a perspective view of one example of a work space system, including multiple work stations and work spaces, according to another embodiment.

In the example illustrated in FIG. 27, the work space system 1000 configuration includes four adjacent work spaces 100A, 100B, 100C, 100D arranged in a cross shape. First and second work spaces 100A and 100B share the first wall panel 104 and the respective work stations are pivotally mounted to the shared distal vertical frame member 110*d* so that work stations 10A and 10B can pivot relative to the shared first wall panel 104. Third and fourth work spaces 100C and 100D are similarly arranged and share their own first wall panel 104, and respective work stations 10C and 10D can pivot relative to the shared first wall panel 104. In this illustrated arrangement, the work stations 10A and 10B of the first and second work spaces 100A and 100B are disposed in their second position E and first position D, respectively. Likewise, the work stations 10C and 10D of the third and fourth work spaces 100C and 100D are disposed in their second position E and first position D, respectively. It should be understood that the work stations could each be positioned in any configuration as desired.

Figure 28:
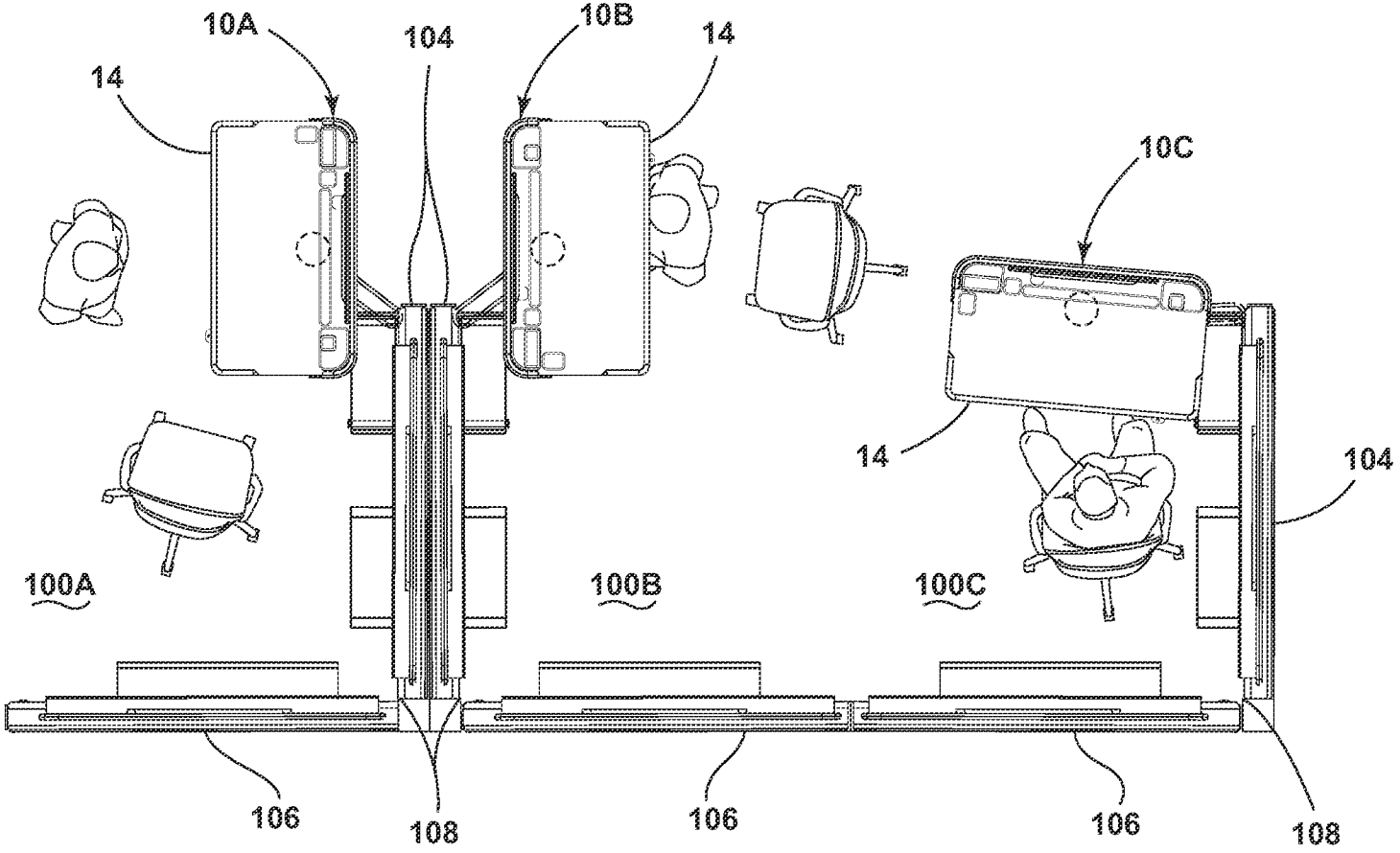
FIG. 28 is a top view of an exemplary arrangement of the work space system.
Figure 29:
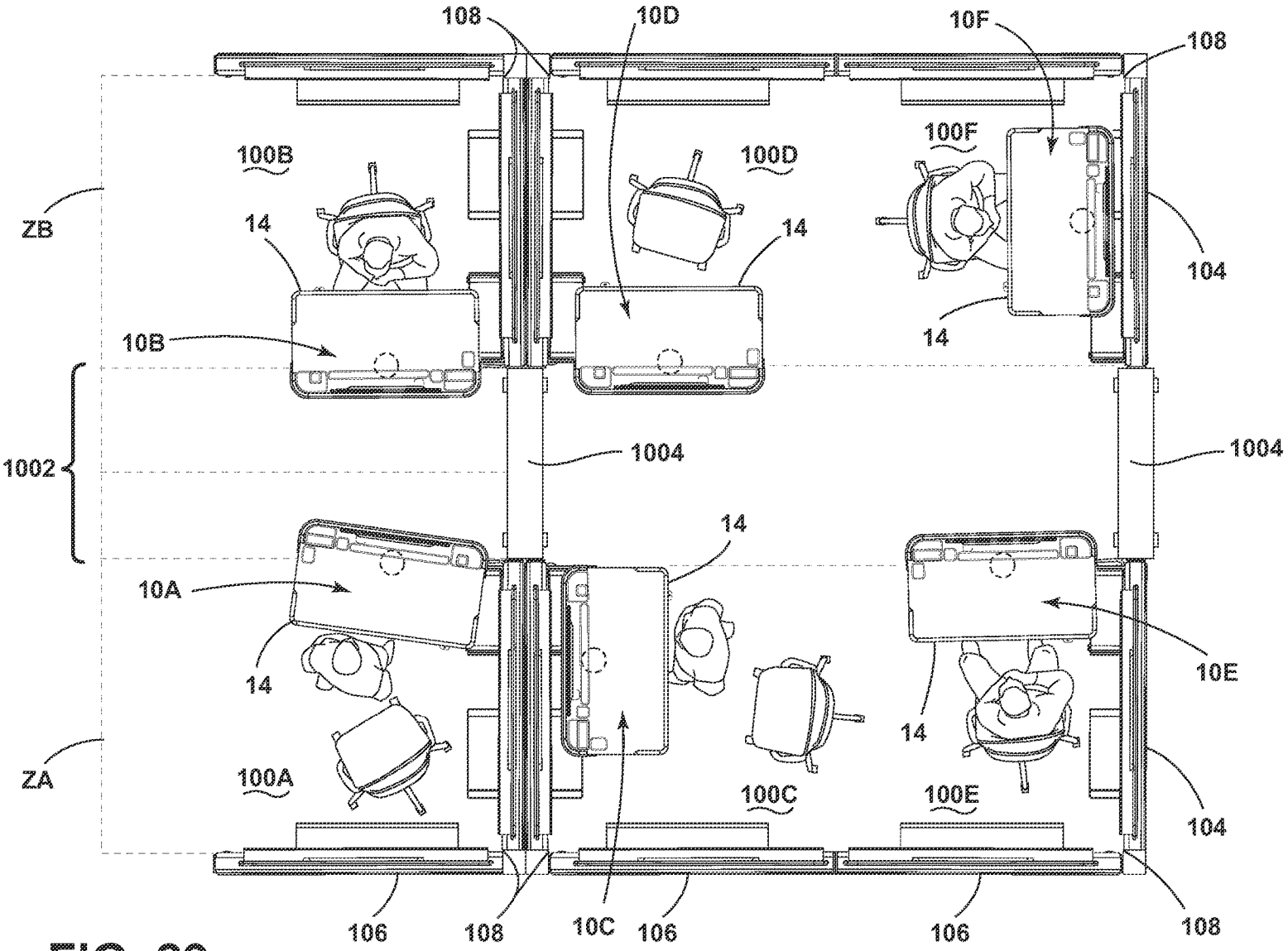
FIGS. 29-33 are top views of other exemplary arrangements of the work space system, illustrating different examples of work station and work space configurations.
Figure 30:
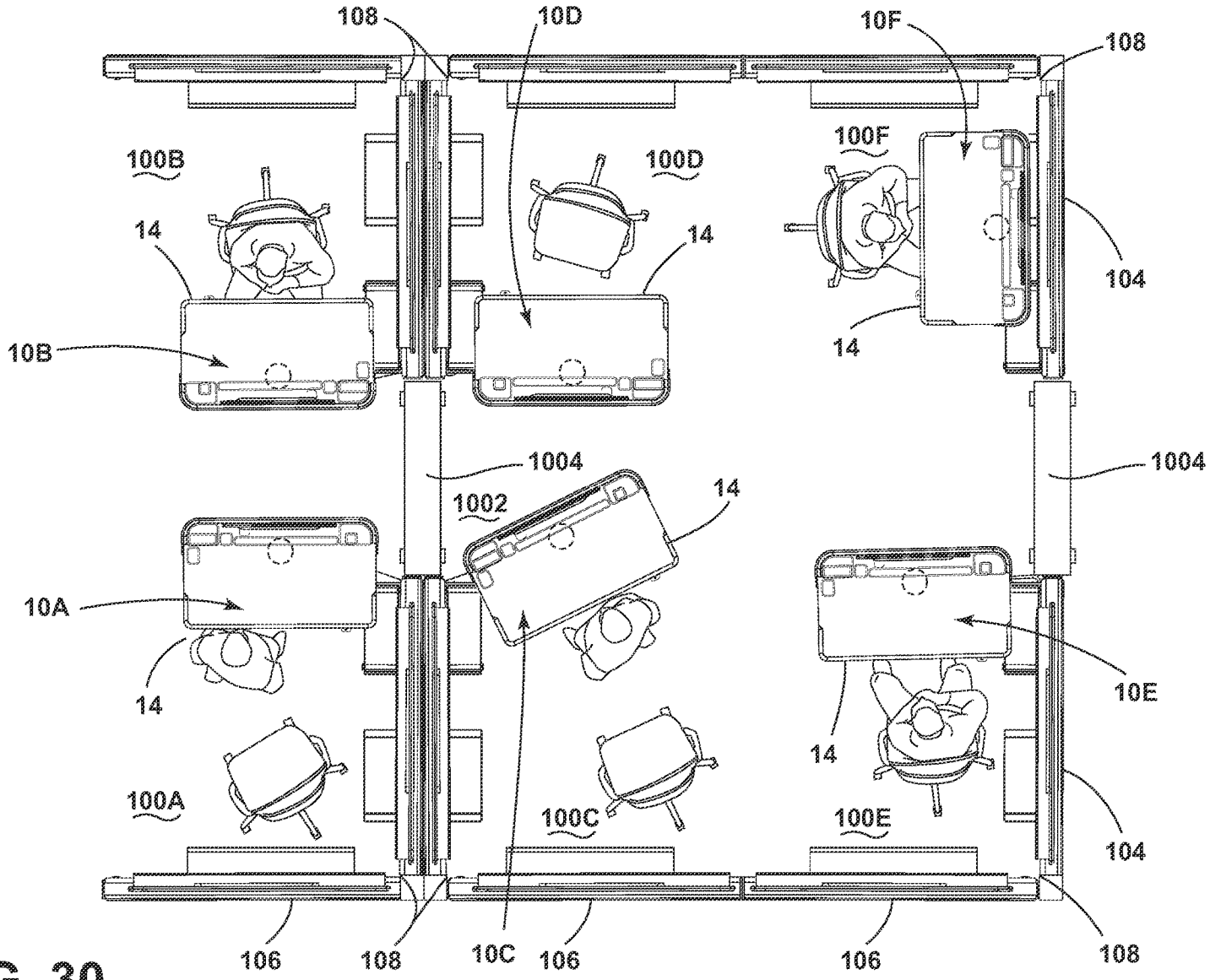
Figure 31:
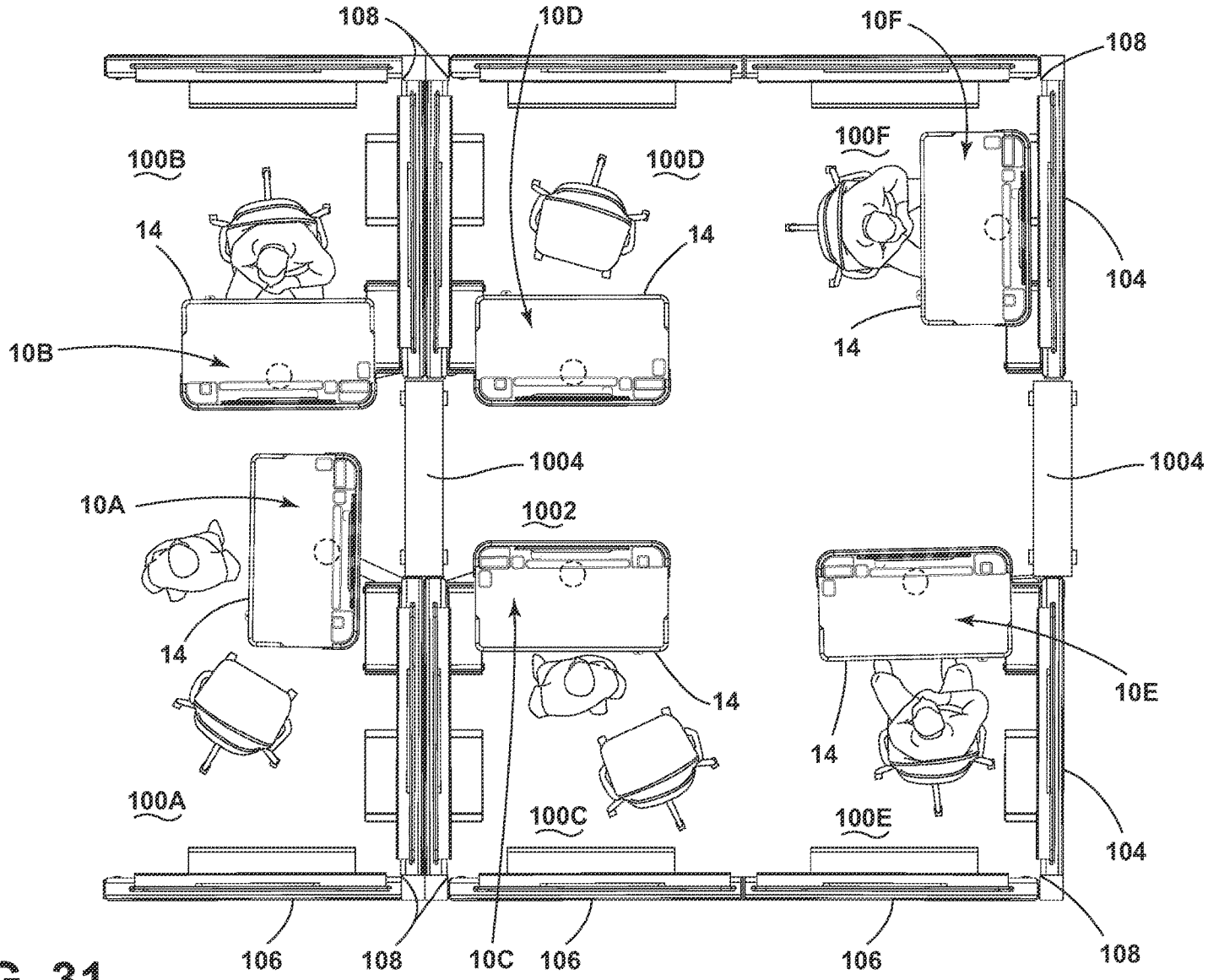

The exemplary work space system 1000 arrangement shown in FIG. 28 illustrates another work station arrangement where the two work spaces 100A, 100B are arranged in a substantially t-shaped configuration. In this configuration, the first wall panels 104 are juxtaposed and the second wall panels 106 are collinear and extend in opposite directions. Alternatively, adjacent work stations can share one first wall panel. In this example, the work stations 10A and 10B are pivoted to their respective third positions F so that their respective work surfaces 14 are positioned closer to one another. The work surfaces 14 may be arranged substantially back-to-back, as shown, or could be rotated to be arranged side-to-side. Positioning the work surfaces 14 of the work stations 10 adjacent one another defines a collaborative work station configuration. In this collaborative work station configuration, the work surfaces 14 are grouped together to enhance group collaboration and communication as desired. It should be understood that multiple work stations can be coupled with one another in any number of possible arrangements to subdivide and organize the floor space as desired.

Another exemplary arrangement is illustrated in FIGS. 29-33 where the work space system 1000 includes multiple work spaces 100 separated by a walkway 1002, sometimes referred to as an aisle, passageway, or corridor. The exemplary work space system 1000 includes six work spaces 100A-F arranged in two rows in mirror-image relationship across the walkway 1002 from one another. First and second work spaces 100A and 100B are arranged to open toward one another and their first wall panels 104 are collinear, but spaced across the walkway 1002 therebetween. The first and third work spaces 100A and 100C are arranged adjacent one another so that their first wall panels 104 are in juxtaposition and their second wall panels 106 are collinear. Likewise, the second and fourth work spaces 100B and 100D are arranged adjacent one another so that their first wall panels 104 are in juxtaposition and their second wall panels 106 are collinear. A fifth work space 100E can be arranged so that the second wall panels 106 of the third and fifth work spaces 100C and 100E are collinear. Similarly, the sixth work space 100F is arranged so that the second wall panel 106 of the fourth and sixth work spaces 100D and 100F are collinear. It should be noted that the fifth and sixth work spaces 100E, 100F could instead be aligned with the first and second work spaces 100A, 1008, or could be eliminated. Further, any number of additional work stations could be included as feasible and desired for the particular office space, etc.

Figure 32:
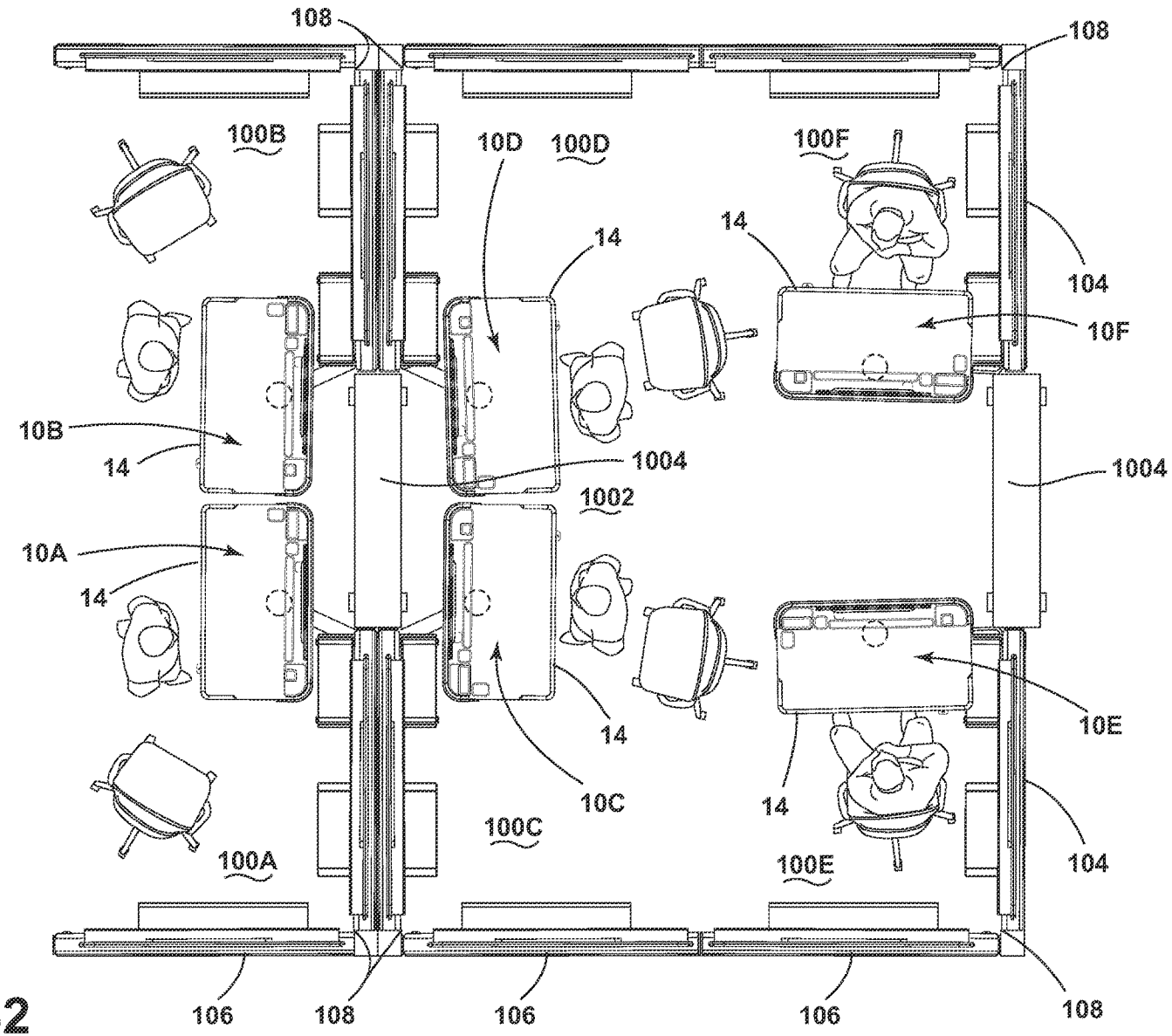
Figure 33:
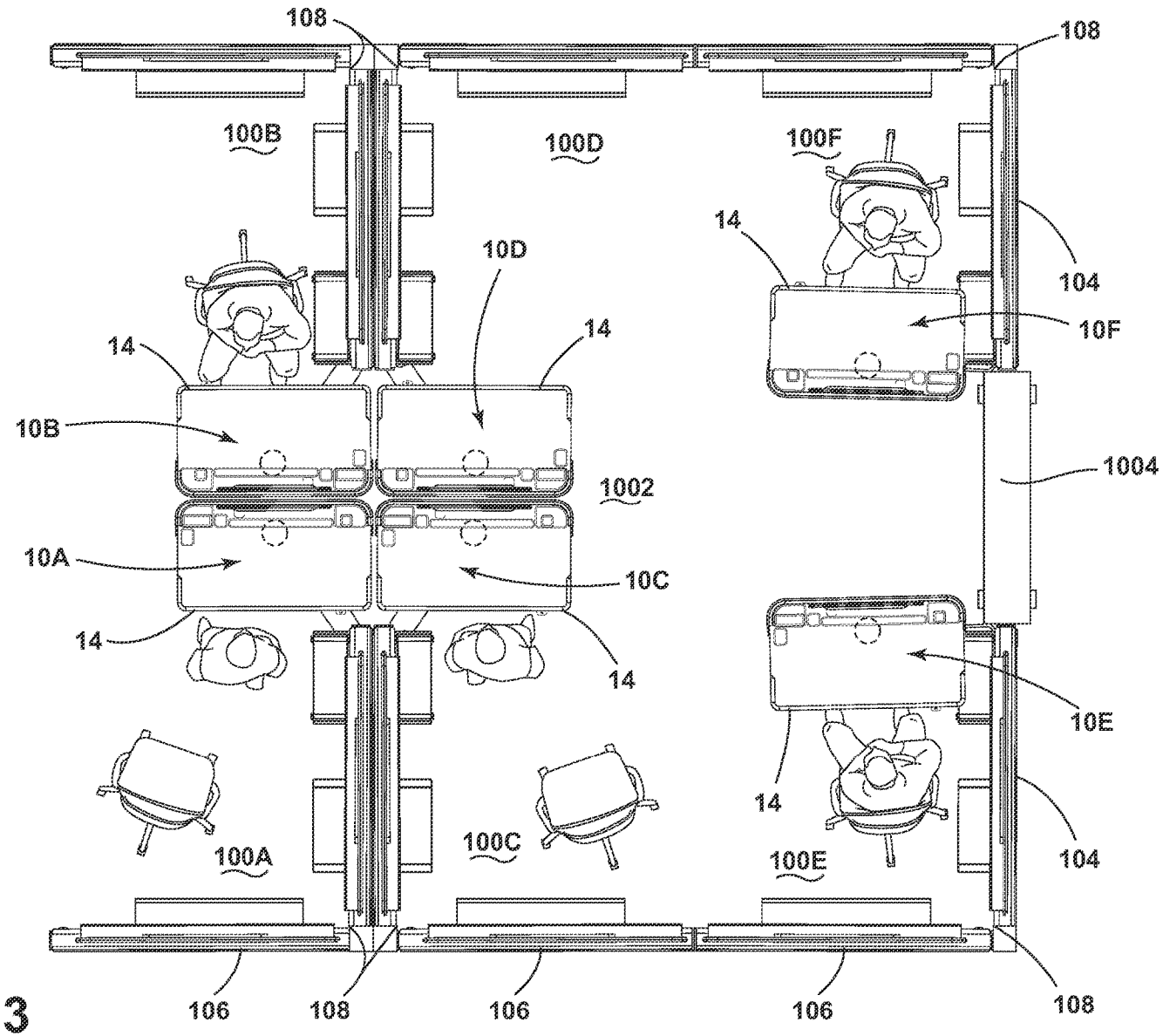

In the work space system 1000 arrangement of FIGS. 32-33, the work stations 10 of the first, second, third, and fourth work spaces 100A-100D can be pivoted to their respective third positions F. With all four work surfaces 14 of the work spaces 100A-100D positioned adjacent one another, the work surfaces 14 can form a group. The work surfaces 14 can be oriented in pairs in side-to-side relationships, as shown in FIG. 32, or all four work surfaces can be moved adjacent one another to form a grouping positioned at least partially within the walkway 1002, as shown in FIG. 33. Of course, as described above and illustrated in FIGS. 29-33, the work surfaces 14 and work stations 10 can be pivotally positioned, rotationally oriented, and height adjusted to intermediate positions as desired by the user. Each of the work stations can be positioned in any number of intermediate positions between the first and third positions, and each work surface can be rotated to any number of intermediate orientations. In the case where the work surfaces 14 are ovate or "pill-shaped", exact alignment of adjacent work surfaces 14 is de-emphasized because whether the sides of the work surfaces are precisely parallel or perpendicular is obscured by the curved surfaces. The configurations and orientations described herein can provide both a private and a collaborative, work conducive environment. Alternatively or optionally, any of the described work spaces herein could include a position limiter for preventing the work station from extending beyond a desirable range of motion; perhaps in some implementations preventing the work station from extending into the walkway. The position limiter could be in the form of any suitable pin, stop, detent, etc. used to prevent further pivot of the work station.

The work space system 1000 can include a threshold 1004 positioned on the floor surface, between wall panels 104, 106 of work spaces 100 on opposite sides of the walkway 1002. The threshold 1004 can be used to run power or data cables, ribbons, and other cords between spaced work stations, beneath the threshold(s) 1004. The threshold 1004 provides a solution for running power and data between spaced work stations, without requiring conventional raised floors or ceiling drops. Power and data cables and cords (not shown) can run, for example, through the wall panel 104 of a first work space 100, down one of the vertical frame members 110, across the walkway 1002 and under the threshold 1004, up another vertical frame member 110, and through another wall panel 104. In this manner, power and data can be extended between any number of spaced work stations.

The disclosed work space system 1000 can improve floor space optimization by providing a more dense work space 100 arrangement. Notably, the work space system 1000 may comply with the rules and regulations of various governing bodies, for example the Americans With Disabilities Act ("ADA") which calls for a minimum aisle width of 36". The following dimensions are provided for explanatory purposes and are not intended to be so limiting. In this example, each work station is allotted a 72" square footprint of floor space, denoted ZA and ZB in FIG. 29. Referring to the work station arrangement illustrated in FIGS. 29-33, placing two work spaces 100A, 100B across the walkway 1002 and open toward one another allows respective footprints ZA and ZB to overlap while still providing a 36" walkway between the work stations. Each work station "contributes" to the width of the walkway 1002, thereby reducing the overall footprint of the work space system 1000 (comprising the work spaces 100A, 100B and walkway 202). In the configuration of FIGS. 29-33, the footprints ZA, ZB of the two workstations overlap. The length of each wall panel 104 is 54" and the width of the walkway 1002 formed between the wall panels 104 is 36", for an overall length of 144" (54"+36"+54"). In an alternate configuration, if the work spaces 100A and 100B were arranged in a back-to-back orientation so that the work stations are closed to one another, with first wall panels 104 collinear and second wall panels 106 adjacent one another, the overall footprint of the alternate work space system would be greater. In this less dense arrangement, a full width walkway 1002 would be required at the distal end of each of the wall panels 104 to allow entry/exit into the work station, for an overall length of 180" (36"+54"+54"+36"). Accordingly, the work space system 1000 disclosed herein provides spaced work stations that can be electrically connected by utilizing the threshold 1004 and can be more densely arranged than conventional systems.

The work station, work spaces, and work space system described herein can be adapted to accommodate a variety of environments. The work station 10 work surface 14 may be adjustable in both its rotational orientation and height and provides a number of different configurations in which it can be arranged and rearranged/reconfigured relative to the work space. The work space system 1000 creates independent, personal work spaces with all the user control, accessibility, and functionality that workers need for individual work, while offering group collaboration and communication sometimes desired in an office environment. The ability to arrange individual work spaces into a work space system 1000 provides a customizable floor plan and office layout as needed. The work space system 1000 herein provides an adaptable solution designed for quick reconfigurations within open floor plans. Examples of a select few of the orientation combinations and configurations are shown in FIGS. 29-33.

The above description is that of current embodiments of the disclosure herein. Various alterations and changes can be made without departing from the spirit and broader aspects of the disclosure as defined in the appended claims, which are to be interpreted in accordance with the principles of patent law including the doctrine of equivalents. This disclosure is presented for illustrative purposes and should not be interpreted as an exhaustive description of all embodiments of the disclosure or to limit the scope of the claims to the specific elements illustrated or described in connection with these embodiments. For example, and without limitation, any individual element(s) of the described disclosure may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A reconfigurable work station comprising:

a work surface supported atop a pedestal and a base, the base positioned on a floor surface; and a linkage arm having first and second ends, the linkage arm affixed to the base or the pedestal at the first end and pivotally connected to a fixed member at the second end;

wherein the work station is configured to be pivoted with the linkage arm about the fixed member as the fixed member remains fixed with respect to the floor surface such that the work station is selectively positionable in a plurality of positions;

wherein the work surface is rotatable with respect to the pedestal about a rotation axis spaced from the fixed member, and the position of the rotation axis moves about the fixed member along an arc defined by the linkage arm as the work station is selectively positioned.

2. The reconfigurable work station of claim 1, wherein the pedestal is height adjustable and the work surface is configured to raise and lower.

3. The reconfigurable work station of claim 1 wherein the pivotal connection of the first end of the linkage arm to the base or the pedestal includes a pivot pin, the pivot pin fixed in position and the linkage arm pivoting about the pivot pin.

4. The reconfigurable work station of claim 3, wherein pivot of the work station, and raising or lowering of the work surface are independent of one another.

5. The reconfigurable workstation of claim 4 wherein the rotation axis of the work surface is aligned with the pedestal.

6. The reconfigurable work station of claim 1, wherein the work station is adapted to pivot at least 90°.

7. The reconfigurable work station of claim 1, including a power outlet and a data port mounted to the work surface.

8. The reconfigurable work station of claim 1, wherein the linkage arm is positioned adjacent a lower end of at least one of the pedestal and the base, substantially adjacent to the floor surface.

9. The reconfigurable work station of claim 1, wherein the pedestal is height adjustable and includes fixed and extending portions, and the linkage arm is affixed to the fixed portion of the pedestal at a height above a floor surface.

10. The reconfigurable work station of claim 1, wherein the work station is mounted within a work space comprising one or more wall panels, the linkage arm pivoting with respect to the one or more wall panels.

11. The reconfigurable work station of claim 10 including two of the wall panels, the wall panels forming a corner, and the linkage arm pivoting with respect to the corner.

12. The reconfigurable work station of claim 1, wherein the linkage arm is pivotally connected to the base at the first end, wherein the work station is configured to pivot about the fixed member to change the position of the work station, and the base, pedestals, and work surface can pivot about the second end of the linkage arm to rotate the work surface.

13. The reconfigurable work station of claim 1, wherein the linkage arm is a two piece linkage arm including two pivotally joined segments.

14. A reconfigurable work space comprising:

a fixed member fixed in position with respect to a floor surface; and a work station comprising:

a work surface supported atop a pedestal and a base; and a linkage arm having first and second ends, the linkage arm connected to the base at the first end and pivotally connected to the fixed member at the second end;

wherein the work station is configured to pivot with the linkage arm such that the work station is positionable in a plurality of positions relative to the work space;

wherein the work surface is rotatable with respect to the pedestal about a rotation axis spaced from the fixed member, and the position of the rotation axis moves about the fixed member along a path defined by the linkage arm as the work station is selectively positioned.

15. The reconfigurable work space of claim 14, wherein the pedestal is height adjustable and the work surface is configured to raise and lower.

16. The reconfigurable work space of claim 14, wherein the work surface is rotatably mounted atop the pedestal, with the rotation axis aligned with the pedestal.

17. The reconfigurable work space of claim 14, including first and second fixed elements, wherein each of the fixed elements has a longitudinal extent, and wherein the longitudinal extents of the first and second fixed elements are arranged perpendicular to one another and define a boundary and a corner therebetween, wherein the linkage arm is connected to the first fixed element at a location spaced from the corner.

18. The reconfigurable work space of claim 17, wherein the work station is adapted to pivot between at least first, second, and third positions, wherein, in the first position, the linkage arm is pivoted toward the corner such that the work surface is positioned within the boundary of the first and second fixed elements, wherein, in the second position, the linkage arm is pivoted away from the corner such that the work surface is spaced from the corner and at least a portion of the work surface is positioned within the boundary of the first and second fixed elements, wherein, in the third position, the linkage arm is pivoted away from the corner such that the work surface is spaced from the corner and positioned substantially outside the boundary of the first and second fixed elements.

19. The reconfigurable work space of claim 18, wherein the work station is adapted to pivot at least 90°, and the work surface is rotatably mounted atop the pedestal and is adapted to rotate at least 180°.

20. The reconfigurable work space of claim 18, wherein the work station is adapted to be positioned in a plurality of intermediate positions between the first and third positions.

21. The reconfigurable work space of claim 18, wherein the work surface defines first and second sides and the work surface is rotatably mounted atop the pedestal and is adapted to rotate between orientations where the first side is parallel to the first fixed element, where the first side is perpendicular to the first fixed element, and where the first side is disposed in a plurality of intermediate orientations.

22. The reconfigurable work space of claim 14, including first and second fixed elements, wherein each of the fixed elements has a longitudinal extent, and wherein the longitudinal extents of the first and second fixed elements are arranged perpendicular to one another and define a boundary and a corner therebetween, wherein the linkage arm is connected to the first fixed element substantially adjacent the corner.

23. A reconfigurable work space system comprising:

first and second work spaces each comprising a fixed element, the first and second work spaces spaced from one another, the first and second work spaces each defining a boundary, the boundary of the first work space spaced from the boundary of the second work space to define a walkway therebetween; and first and second work stations, each of the first and second work stations comprising:

a work surface supported atop a pedestal and a base; and a linkage arm extending between and pivotally connecting the pedestal or the base to the fixed element, a first end of the linkage arm connected to the fixed element within the boundary, a second end of the linkage arm connected to the pedestal or the base;

wherein the work surface of the first work station is configured to pivot with the linkage arm relative to the fixed element to which it is connected, and the work surface of the second work station is configured to pivot with the linkage arm relative to the fixed element to which it is connected, whereby the first and second work stations are each independently positionable in a plurality of positions relative to the work space, wherein the first linkage arm defines a movement path for the pedestal of the first work station that confines the pedestal to a fixed spatial relationship with respect to the boundary of the first work space, and the second linkage arm defines a movement path for the pedestal of the second work station that confines the pedestal to a fixed spatial relationship with respect to the boundary of the second work space.

24. The reconfigurable work space system of claim 23, wherein the pedestal is height adjustable and the work surface is configured to raise and lower.

25. The reconfigurable work space system of claim 23, wherein, for each work space, the fixed element is a wall panel, wherein the wall panel of the first work space is arranged at least one of colinear with or perpendicular to the wall panel of the second work space.

26. The reconfigurable work space system of claim 25, wherein, each work space includes a first wall panel and a second wall panel, the first and second wall panels defining a corner therebetween, each wall panel having a first end and a second end, the first ends abutting at the corner, the second ends opposite the corner, wherein the first wall panel, the second wall panel, and first and second boundary lines form the boundary for each work space, wherein the first boundary line extends from the second end of the first panel to an intersection point with the second boundary line, and the second boundary line extends from the second end of the second panel to the intersection point with the first boundary line.

27. The reconfigurable work space system of claim 26, wherein each of the first and second work stations is pivotable between at least first, second, and third positions wherein:

the linkage arm is pivoted toward the corner such that the work surface is positioned within the boundary when in the first position, the linkage arm is pivoted away from the corner such that the work surface is spaced from the corner and at least a portion of the work surface is positioned within the boundary when in the second position, and the linkage arm is pivoted away from the corner such that the work surface is spaced from the corner and positioned substantially outside the boundary when in the third position.

28. The reconfigurable work space system of claim 27, wherein, in the third position, respective work surfaces of the first and second work stations are adjacent one another.

29. The reconfigurable work space system of claim 28, wherein each work surface is rotatably mounted atop the pedestal, wherein each of the first and second work stations is configured to be positioned in a plurality of intermediate positions between the first and third positions, and each of the work surfaces of the first and second work stations is configured to be rotated to a plurality of orientations.

30. The reconfigurable work space system of claim 26, further including third and fourth work stations, wherein first and third work stations are adjacent one another with first wall panels in juxtaposition and second wall panels collinear, and second and fourth work stations are adjacent one another with first wall panels in juxtaposition and second wall panels collinear.

31. The reconfigurable work space system of claim 30, wherein third and fourth work stations include respective third and fourth work surfaces, wherein, in their third positions, the first, second, third, and fourth work surfaces of respective work stations are adjacent one another, forming a grouping positioned at least partially within the walkway.

* * * * *